US011129463B2

(12) United States Patent
Dinata

(10) Patent No.: US 11,129,463 B2
(45) Date of Patent: Sep. 28, 2021

(54) REFILL LIPSTICK CARTRIDGE

(71) Applicant: PT KEMAS INDAH MAJU CO., LTD., Jakarta (ID)

(72) Inventor: Nata Kumara Dinata, Jakarta (ID)

(73) Assignee: PT KEMAS INDAH MAJU CO., LTD., Jakarta (ID)

( * ) Notice: Subject to any disclaimer, the term of this patent is extended or adjusted under 35 U.S.C. 154(b) by 0 days.

(21) Appl. No.: 17/034,562

(22) Filed: Sep. 28, 2020

(65) Prior Publication Data

US 2021/0093070 A1 Apr. 1, 2021

Related U.S. Application Data

(60) Provisional application No. 62/906,578, filed on Sep. 26, 2019.

(51) Int. Cl.
*A45D 40/12* (2006.01)
*A45D 40/16* (2006.01)
(Continued)

(52) U.S. Cl.
CPC ..... *A45D 40/12* (2013.01); *A45D 40/06* (2013.01); *A45D 40/16* (2013.01); *A45D 2040/0043* (2013.01)

(58) Field of Classification Search
CPC ..... A45D 40/06; A45D 40/12; A45D 40/16; A45D 2040/0043
See application file for complete search history.

(56) References Cited

U.S. PATENT DOCUMENTS 3,083,822 A 4/1963 Clark
3,298,509 A 1/1967 Hultgren
(Continued)

FOREIGN PATENT DOCUMENTS

JP H07-031510 A 2/1995
JP 2010-131279 A 6/2010
(Continued)

OTHER PUBLICATIONS

International Search Report and Written Opinion, dated Dec. 8, 2020, for related International Application No. PCT/IB2020/000790, filed Sep. 28, 2020 (7 pages).

*Primary Examiner* — Jennifer C Chiang
(74) *Attorney, Agent, or Firm* — Daniel F. Nesbitt; Hasse & Nesbitt LLC

(57) ABSTRACT

A refill lipstick cartridge that prevents or avoids operation of the dispensing mechanism for the lipstick until the cartridge has been secured into the lower case of a lipstick case. The refill lipstick cartridge has a locked or non-functioning configuration, in which the lipstick cannot be dispensed from the refill lipstick cartridge until the refill lipstick cartridge is installed into the lower case of the lipstick case, and an unlocked or functioning configuration when installed into the lipstick case, in which the dispensing mechanism for the lipstick can function to both extend from the lipstick bullet, and retract the lipstick bullet into, the lipstick case, typically manually under the control of the user of the lipstick product. A locking mechanism that employs either friction or mechanical locking elements is manipulated to position the refill lipstick cartridge between the locked configuration and the unlocked configuration.

16 Claims, 22 Drawing Sheets

(51) Int. Cl.
*A45D 40/06* (2006.01)
*A45D 40/00* (2006.01)

(56) References Cited

U.S. PATENT DOCUMENTS

| | | | | | |
|---|---|---|---|---|---|
| 3,429,643 | A | | 2/1969 | Seaver | |
| 3,838,169 | A | | 9/1974 | Thominet | |
| 4,820,070 | A | | 4/1989 | Spatz | |
| 5,197,814 | A | | 3/1993 | Lombardi et al. | |
| 5,399,040 | A | | 3/1995 | Holloway | |
| 5,468,084 | A | | 11/1995 | Boninsegni et al. | |
| 5,599,124 | A | | 2/1997 | Ackermann et al. | |
| 5,609,430 | A | | 3/1997 | Mazzola et al. | |
| 5,649,777 | A | * | 7/1997 | Holloway | A45D 40/06 401/74 |
| 5,984,552 | A | | 11/1999 | Ackermann et al. | |
| 5,997,206 | A | | 12/1999 | Lin | |
| 6,139,208 | A | | 10/2000 | Monin-Bareil | |
| 8,132,977 | B2 | * | 3/2012 | Pires | A45D 40/06 401/88 |
| 8,328,445 | B2 | * | 12/2012 | Martins | A45D 40/06 401/78 |
| 9,420,869 | B2 | | 8/2016 | Huang et al. | |
| 9,723,907 | B2 | | 8/2017 | Huang et al. | |
| 9,930,953 | B2 | | 4/2018 | Liard et al. | |
| 10,098,436 | B2 | | 10/2018 | Bonnin et al. | |
| 2004/0134819 | A1 | | 7/2004 | Blackwell | |
| 2018/0070703 | A1 | | 3/2018 | Kikuchi et al. | |
| 2018/0220773 | A1 | | 8/2018 | Denece | |
| 2019/0246769 | A1 | | 8/2019 | Genelot et al. | |

FOREIGN PATENT DOCUMENTS

| | | | | | |
|---|---|---|---|---|---|
| WO | WO-2014073819 | A1 | * | 5/2014 | A45D 40/16 |
| WO | 2015189507 | A1 | | 12/2015 | |
| WO | 2019115922 | A1 | | 6/2019 | |
| WO | 2019115923 | A1 | | 6/2019 | |
| WO | 2019115924 | A1 | | 6/2019 | |
| WO | 2020185911 | A1 | | 9/2020 | |

* cited by examiner

REFILL LIPSTICK CARTRIDGE

CROSS-REFERENCE TO RELATED APPLICATION

The present application claims the benefit of U.S. Provisional Application Ser. No. 62/906,578 filed Sep. 26, 2019, the disclosure of which is incorporated by reference in its entirety.

FIELD OF THE INVENTION

The present invention relates to a refill lipstick cartridge for a lipstick product.

BACKGROUND OF THE INVENTION

Products having a stick-like form for dispensing are generally in the nature of semi-solid or highly viscous materials, such as known cosmetic products which include lipstick, eye shadow, eye liner, mascara, and the like. Other products which are dispensable in stick-like form are known as personal care and hygiene products, for example, deodorants, lip balms, sunscreens, insect repellents and the like. Generally, there are known other products such as household products which can be dispensed in stick-like form, for example, adhesives, polishes, and the like. There is therefore known a number of products in stick-like form which are dispensable for various applications.

One form of a known dispenser for cosmetics is referred to as a lipstick case. The lipstick case generally includes a housing which is covered by a removable cap when the contained lipstick in stick-like form is in a retracted position. In some lipstick products, the outer casing and the cap can be a decorative or luxury style. Upon removing the cap, the lipstick is advanced through the housing by means of a mechanism to expose the lipstick for application. The lipstick is typically mounted in a holder or a cup, which is engaged by the mechanism to enable the lipstick to be moved within the housing between a retracted storage position and an extended user or application position. The lipstick is retained within its holder or cup during ordinary handling and use. Once the lipstick has been used or has come to the end of its useful life, the entire lipstick case is discarded.

To reduce the amount of material that is discarded, a refillable lipstick cartridge can be provided wherein a fresh lipstick or lipstick holder can be installed into an existing outer case. The lipstick bullet only can be replaced, or the lipstick within its holder or cup can be replaced. In another case, the lipstick, the holder, and the dispensing mechanism can be replaced. In these cases, the fillable lipstick needs to be inserted into an outer casing by the user, and during installing of the lipstick, the dispensing mechanism may be activated, which can result in premature dispensing of the lipstick or a jamming of the mechanism.

Accordingly, there is still a need to improve refillable lipsticks and lipstick products.

SUMMARY OF THE INVENTION

The present invention provides a refill lipstick cartridge that prevents or avoids operation of the dispensing mechanism for a lipstick bullet within the refill lipstick cartridge until the refill lipstick cartridge has been secured into a lower case of a lipstick case. The refill lipstick cartridge can be adapted into a locked or non-functioning position or configuration, in which the lipstick bullet cannot be dispensed from the refill lipstick cartridge, unless and until the refill lipstick cartridge is installed into the lower case of the lipstick case. Installed into the lower case of the lipstick case, the refill lipstick cartridge has been manipulated into an unlocked and functioning configuration, at which the dispensing mechanism can function to both extend manually the lipstick bullet from, and retract manually the lipstick bullet into, the lower case under the control of the user of the lipstick product.

The present invention provides a refill lipstick cartridge that prevents dispensing of a lipstick employing the refill lipstick cartridge until the refill lipstick cartridge has been secured into a lower case. The refill lipstick cartridge is secured by pushing a base end of the refill lipstick cartridge down into the lower case of the lipstick case. The refill lipstick cartridge comprises a spiral outer tube, a slotted inner tube disposed concentrically within the spiral outer tube, and a lipstick cup disposed within the slotted inner tube, and includes a locking means between the two or more tubes, to prevent the dispensing of the lipstick bullet while the cartridge is not secured into the lower case.

The present invention also provides a refill lipstick cartridge that prevents or avoids operation of the dispensing mechanism for a lipstick bullet until the refill lipstick cartridge has been secured into a lower case of a lipstick case, the refill lipstick cartridge comprising: (i) a spiral outer tube comprising a cylindrical wall, (ii) a slotted inner tube comprising a cylindrical wall, disposed concentrically within the spiral outer tube, wherein the slotted inner tube can be adapted to rotate within the spiral outer tube, and to move axially within the spiral outer tube between a locked position and an unlocked position, (iii) a lipstick cup disposed and adapted to move axially within the slotted inner tube when the slotted inner tube rotates within the slotted inner tube; and (iv) a locking means between the spiral outer tube and the slotted inner tube, wherein the locking means inhibits or prevents relative rotation between the spiral outer tube and the slotted inner tube when the spiral outer tube and the slotted inner tube are axially in the locked position, and the locking means does not inhibit relative rotation between the spiral outer tube and the slotted inner tube when the spiral outer tube and the slotted inner tube are axially in the unlocked position.

In various embodiments, the spiral outer tube moves axially relative to the slotted inner tube, from the locked position to the unlocked position, when the refill lipstick cartridge is inserted into a lower case.

In various embodiments, the locking means can comprise a frictional locking means having one or more frictional locking elements, or a mechanical locking means having one or more mechanical locking elements, or a combination thereof having a combination of frictional and mechanical locking elements.

In various embodiments, the spiral outer tube is configured to move axially, or be moved manually and axially, relative to the slotted inner tube, upwardly or downwardly along the axial centerline, between an axially upper position that is the locked position, at which a mechanical or frictional element of the spiral outer tube mechanically or frictionally engages a corresponding or congruent mechanical or frictional element of the slotted inner tube, and resists, inhibits or prevents relative rotation of the slotted inner tube within the spiral outer tube, and an axially lower position that is the unlocked configuration, at which the mechanical or frictional element of the spiral outer tube disengages from the mechanical or frictional element of the slotted inner tube, and permits or allows relative and frictionless rotation of the slotted inner tube within the spiral outer tube.

In various embodiments, a frictional locking means comprises one or more annular protrusions extending radially inwardly from an inside surface of the cylindrical wall of the spiral outer tube, and an annular outer surface of the cylindrical wall of the slotted inner tube, wherein the inwardly-extending one or more annular protrusions overlap radially with the annular outer surface, and wherein the inwardly-extending one or more annular protrusions of the spiral outer tube overlap axially with the annular outer surface of the slotted inner tube when the spiral outer tube and the slotted inner tube are axially in the locked position, and the inwardly-extending one or more annular protrusions of the spiral outer tube are displaced axially from, and do not overlap axially with, the annular outer surface of the slotted inner tube when the spiral outer tube and the slotted inner tube are axially in the unlocked position. In various embodiments, in a locked configuration of the locking means, the inwardly-extending one or more annular protrusions of the spiral outer tube are engaged frictionally with the annular outer surface of the slotted inner tube, to inhibit or prevent relative rotation, and in an unlocked configuration of the locking means, the inwardly-extending one or more annular protrusions of the spiral outer tube are displaced axially from the annular outer surface of the slotted inner tube, and are respectively disengaged mechanically and frictionally, to allow relative rotation.

The present invention provides, in various other embodiments, that the locking means comprises one or more annular protrusions extending radially outwardly from an outside surface of the cylindrical wall of the slotted inner tube, and an annular inner surface of the cylindrical wall of the spiral outer tube, wherein the outwardly-extending one or more annular protrusions overlap radially with the annular inner surface, and wherein the outwardly-extending one or more annular protrusions of the slotted inner tube overlap axially with the annular inner surface of the spiral outer tube when the spiral outer tube and the slotted inner tube are axially in the locked position, and the outwardly-extending one or more annular protrusions of the slotted inner tube are displaced axially from, and do not overlap axially with, the annular inner surface of the spiral outer tube when the spiral outer tube and the slotted inner tube are axially in the unlocked position. In various embodiments, in a locked configuration of the locking means, the inwardly-extending one or more annular protrusions of the spiral outer tube are engaged frictionally with the annular outer surface of the slotted inner tube, to inhibit or prevent relative rotation, and in an unlocked configuration of the locking means, the inwardly-extending one or more annular protrusions of the spiral outer tube are displaced axially from the annular outer surface of the slotted inner tube, and are respectively disengaged frictionally, to allow relative rotation.

In various embodiments, the annular protrusion can be a ring or series of ring segments with a raised outermost surface extending distally from the inner surface of the cylindrical wall of the slotted outer tube. The raised outermost surface of the ring or ring segments can have a flat or outward curve profile.

In various embodiments, the outer surface of the slotted inner tube can be a smooth nor non-smooth surface, such as a roughened, irregular, ribbed or patterned surface, provided that the outer surface engages frictionally with the projections in the locked position, and are free from frictional engagement in the unlocked position.

In various embodiments, a mechanical locking means comprises one or more first locking elements comprising a plurality of annularly-spaced-apart outward projections extending radially outwardly from the outside surface of a wall of the slotted inner tube, and one or more second locking elements comprising a plurality of annularly-spaced-apart inward projections extending radially inwardly from the annular inner surface of a wall of the spiral outer tube. In a locked configuration of the mechanical locking means, the plurality of inward projections of the spiral outer tube are disposed in axial alignment within a gap between two adjacent outward projections of the slotted inner tube, to inhibit or prevent relative rotation between the slotted inner tube and the slotted outer tube. In an unlocked configuration of the locking means, the plurality of inward projections of the spiral outer tube are displaced axially from axial alignment with, and are not disposed in a gap between, two adjacent outward projections of the slotted inner tube, to allow relative rotation. Typically, the gap between two adjacent outward projections has a width that is the same or slightly wider than a width of the inward projections, to limit the lateral movement or backlash of the inward projections within the gap of adjacent outward projections.

Conversely, a mechanical locking means can comprise one or more a plurality of annularly-spaced-apart inward projections extending radially inwardly from the inside surface of a wall of the spiral outer tube, and a plurality of annularly-spaced-apart outward projections extending radially outwardly from the annular outer surface of a wall of the slotted inner tube. In a locked configuration, the plurality of outward projections of the slotted inner tube are disposed in axial alignment within a gap between two adjacent inward projections of the spiral outer tube, to inhibit or prevent relative rotation between the slotted inner tube and the slotted outer tube. In an unlocked configuration of the locking means, the plurality of inward projections of the spiral outer tube are displaced axially from axial alignment with, and are not disposed in a gap between, two adjacent outward projections of the slotted inner tube, to allow relative rotation. Typically, the gap between two adjacent inward projections has a width that is the same or slightly wider than a width of the outward projections, to limit the lateral movement or backlash of the outward projections within the gap of adjacent inward projections.

In various embodiments, the slotted inner tube further includes an annular resistive protrusion that extends radially outwardly and overlaps a radially inwardly-extending lower rim of the annular outer surface of the spiral outer tube, which provides or increases a frictional force that is required for axial movement of the spiral outer tube relative to the slotted inner tube, between the locked configuration and the unlocked configuration.

In other embodiments, the spiral outer tube further includes an annular resistive protrusion that extends radially outwardly and overlaps a radially inwardly-extending lower rim of the annular outer surface of the slotted inner tube, which provides or increases a frictional force that is required for axial movement of the spiral outer tube relative to the slotted inner tube, between the locked configuration and the unlocked configuration.

In various embodiments, the spiral outer tube has an opposed pair of helical grooves formed into the inner surface of the cylindrical wall, the slotted inner tube has an opposed pair of vertical slots formed through the cylindrical wall, and the lipstick cup has a cylindrical wall, a lower base, and an opposed pair of pins that extend laterally from the outside surface of the cylindrical wall, the pins extending through the respective vertical slots in the slotted inner tube and a distal end of the pins disposed within the respective helical grooves of the spiral outer tube. The lipstick cup can translate axially and vertically within the slotted inner tube when the spiral outer tube and the slotted inner tube are rotated relatively, one to the other, or both in opposite rotational directions.

In various embodiments, the refill lipstick cartridge further comprises an outer cylinder or sleeve that is fitted over and covering the entire outside surface of the spiral outer tube and over any outside wall surface of the slotted inner tube that may extend from the bottom of the spiral outer tube. The sleeve is secured to the spiral outer tube by a mechanical, friction-fit, or adhesive attachment. The outer cylinder or sleeve inhibits or prevents a user from rotating the spiral outer tube relative to the slotted inner tube, by manipulating only an outer cylindrical surface while holding stationary the slotted inner tube of the refill lipstick cartridge.

In various embodiments, the slotted inner tube further includes a refill drive means fixed to the slotted inner tube, and the refill drive means includes a rotation feature. The lower case of the lipstick case includes a rotation feature, and the lower case of the lipstick case slidably and adjustably receives the outer cylinder of the refill lipstick cartridge, at which the rotation feature of the refill drive means cooperates with the rotation feature of the lower case of the lipstick case, whereby rotation of the lower case of the lipstick case correspondingly rotates the slotted inner tube, and wherein rotation of the lower case of the lipstick case while holding or preventing rotation of the outer cylinder or sleeve (which holds or prevents rotation of the spiral outer tube), and results in axial and vertical translation of the lipstick cup within the slotted inner tube and within the refill lipstick cartridge.

In various embodiments, the rotation feature of the refill drive means of the slotted inner tube is configured to be releasably secured to and engaged with the rotation feature of the lower case of the lipstick case. The rotation feature of the refill drive means includes a mechanical or frictional element, the rotation feature of the lower case includes a congruent or corresponding mechanical or frictional element, and wherein the mechanical or frictional element of the rotation feature of the refill drive means mechanically or frictionally engages with the corresponding or congruent mechanical or frictional element on the rotation feature of the lower case, whereby an insertion force is required to releasably secure and engage the rotation feature of the refill drive means with the rotation feature of the lower case, to overcome the mechanical or frictional interference of the rotation feature between the mechanical or frictional elements of the refill drive means and the mechanical or frictional elements of the rotation feature of the lower case.

In various embodiments, the rotation feature of the refill drive means of the refill lipstick cartridge is configured to be withdrawn manually from engagement with the rotation feature of the lower case by an extraction force that overcomes the mechanical or frictional interference between the mechanical or frictional element of the respective rotation features of the refill drive means and the lower case. In various embodiments, the extraction force to withdraw the refill lipstick cartridge from the lower case is the same or substantially the same as the insertion force to insert the refill drive means into the lower case; an unlocking force to move the slotted inner tube axially within the spiral outer tube from the locked position to the unlocked position, is less than, and typically substantially less than, the insertion force to insert the refill drive means into the lower case, and a locking force to move the slotted inner tube axially within the spiral outer tube from the unlocked position to the locked position, is less than, and typically substantially less than, the extraction force to withdraw the refill lipstick cartridge from the lower case.

In a further embodiment, the refill lipstick cartridge is configured in, and can be manipulated to, a locked or non-functioning configuration prior to insertion of the refill lipstick cartridge into the lower case of the lipstick case, or after the refill lipstick cartridge is removed from the lower case of the lipstick case. According to various embodiments, the refill lipstick cartridge returns to the locked or non-functioning configuration after the refill lipstick cartridge has been pulled outward from the lower case of the lipstick case.

Although the product described herein is a refill lipstick cartridge, the invention also contemplates that other semi-solid or viscous materials can be used in place of a lipstick, including other cosmetic products, personal care and hygiene products, household products and the like which are provided generally in stick-like form. The product holder or cup can include a cup described and illustrated in U.S. Pat. Nos. 3,083,822, 3,298,509, 3,838,169, 4,820,070, 5,197,814, 5,599,124, and 5,609,430, and US Publication 2018/0070703, the disclosures of which are incorporated by reference in their entireties.

According to various embodiments of the present invention, the component parts of the refill lipstick cartridge can be made by an injection molding process and equipment, and are preferably made of a thermoplastic material using an injection molding process.

BRIEF DESCRIPTION OF THE DRAWINGS

The above description, as well as further objects, features and advantages of the present invention will be more fully understood with reference to the following detailed description of a product dispenser and holder, when taken in conjunction with the accompanying drawings.

DETAILED DESCRIPTION OF THE INVENTION

Figure 2:
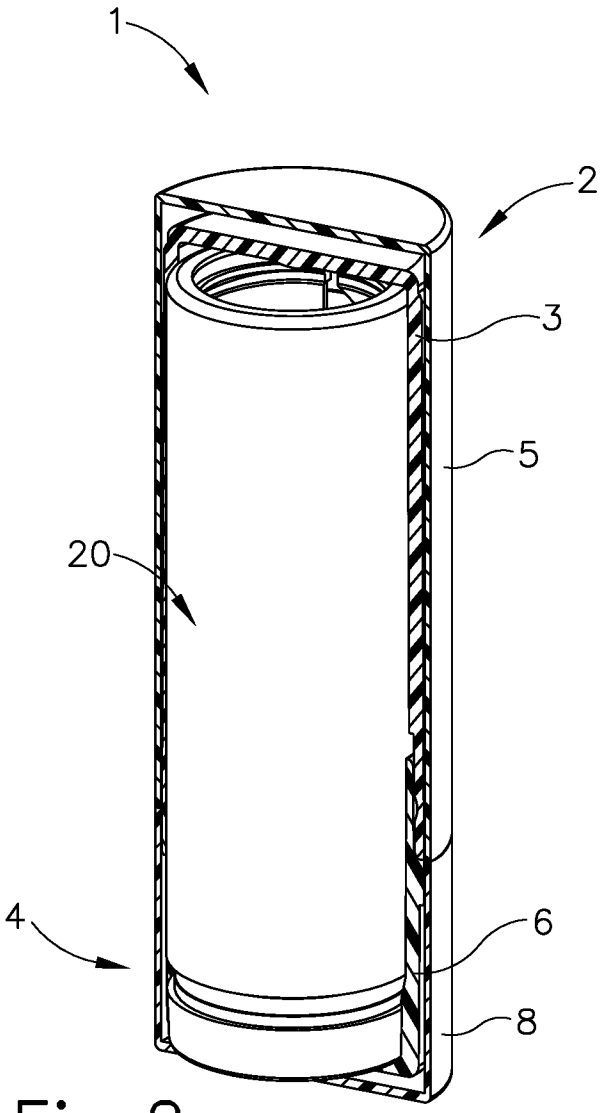
FIG. 2 shows a perspective, cut-away view of the lipstick product dispenser of FIG. 1, showing the refill lipstick cartridge disposed within a lower case and covered with a cover.
Figure 1:
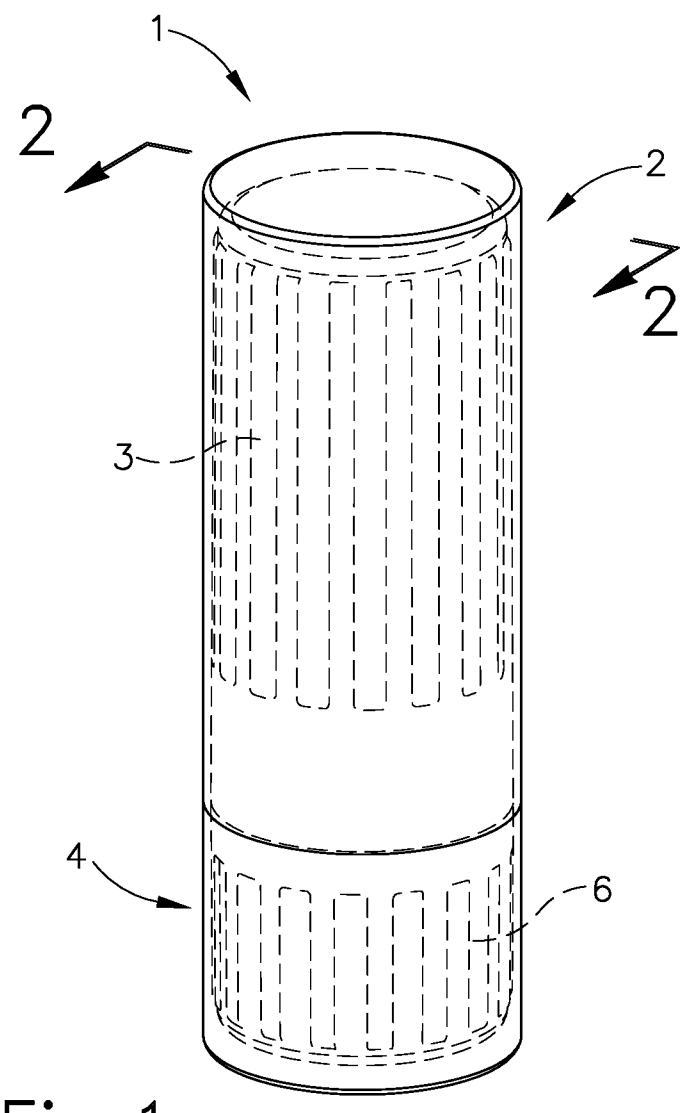
FIG. 1 shows a perspective view of a lipstick product dispenser for a lipstick refill cartridge.
Figure 3:
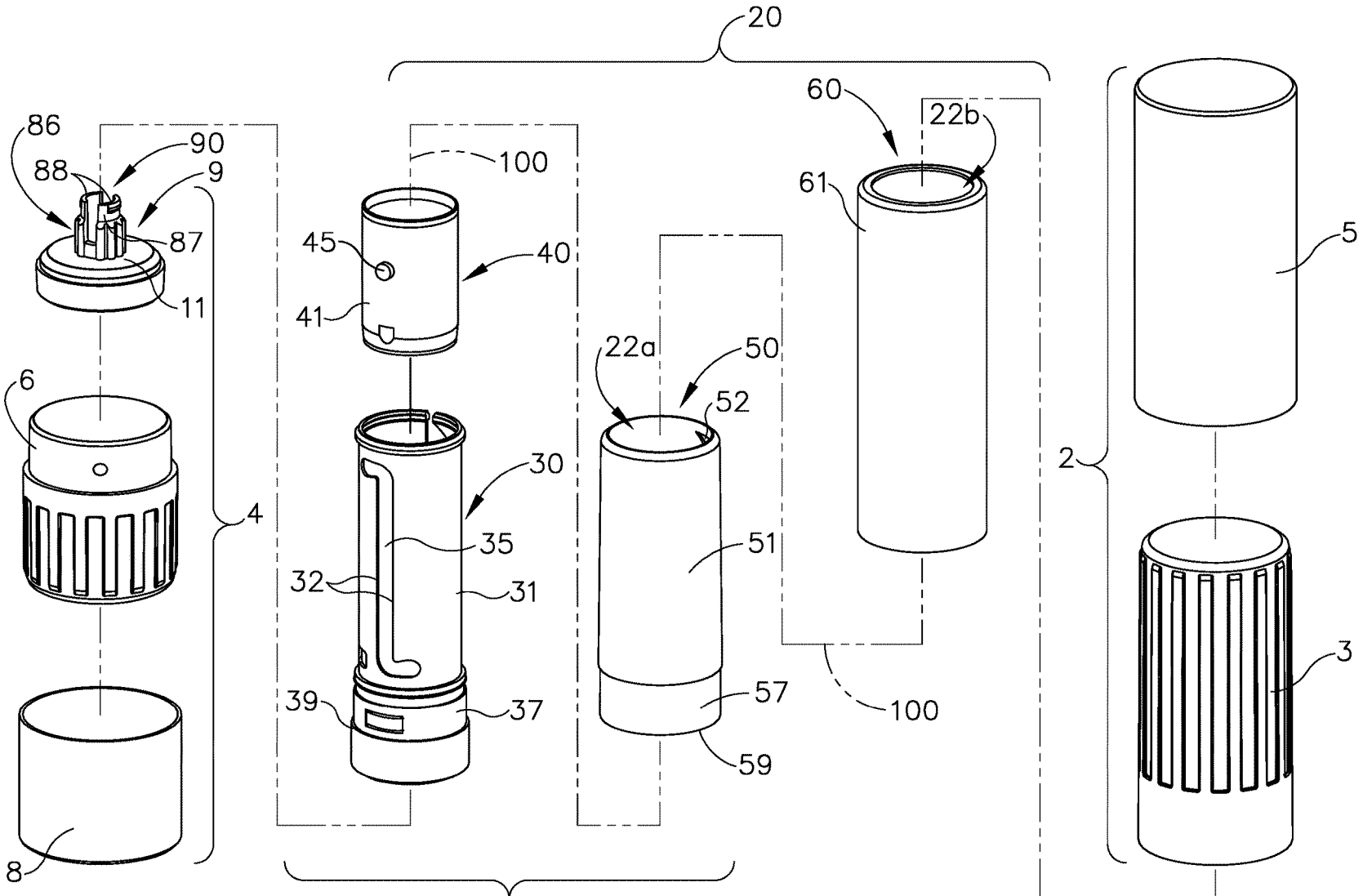
FIG. 3 shows the lipstick product dispenser and the refill lipstick cartridge in separated components, including a spiral outer tube, a slotted inner tube, a lipstick cup, and an outer cylindrical sleeve.
Figure 4:
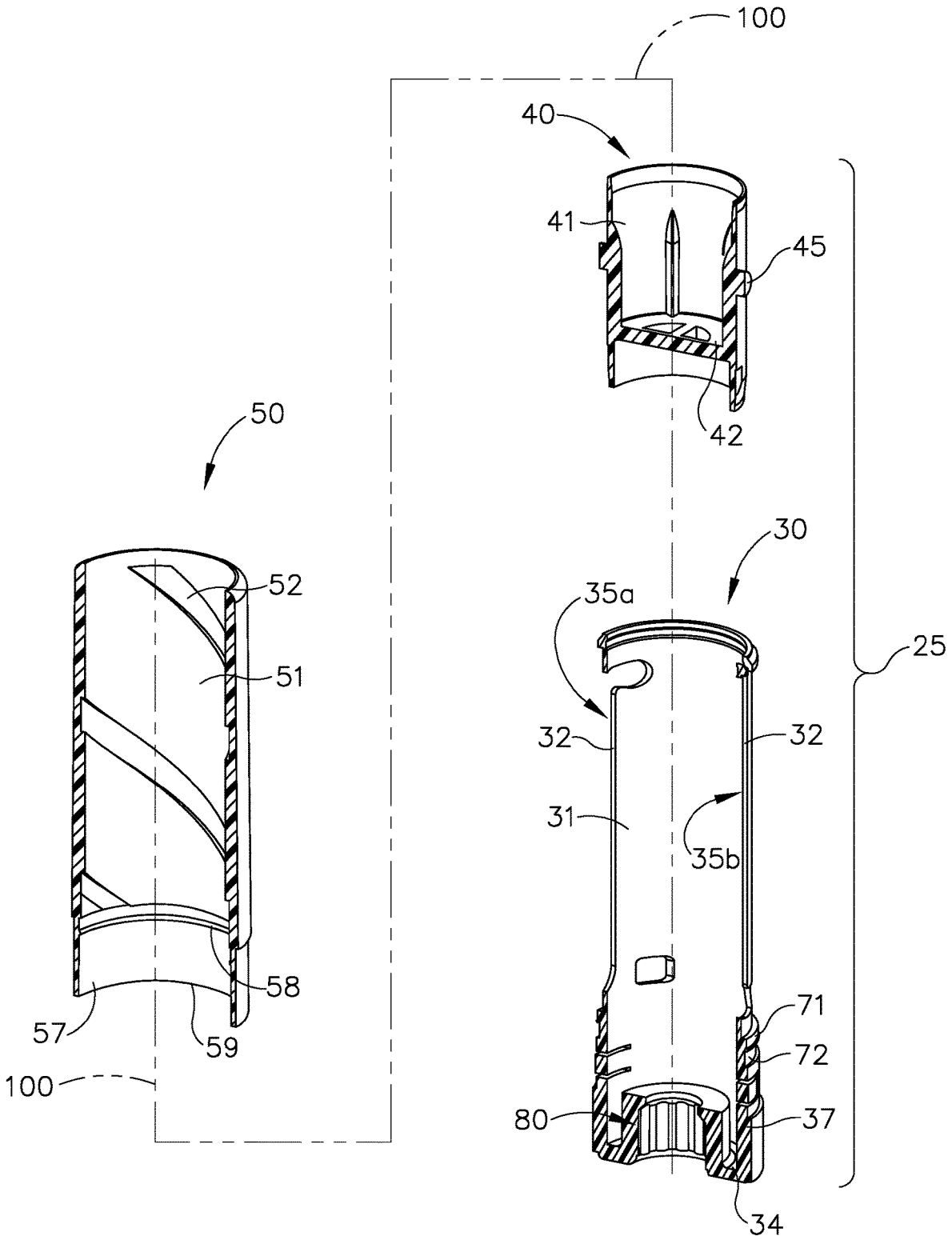
FIG. 4 shows the spiral outer tube, the slotted inner tube, and the lipstick cup in sectional view.
Figure 5:
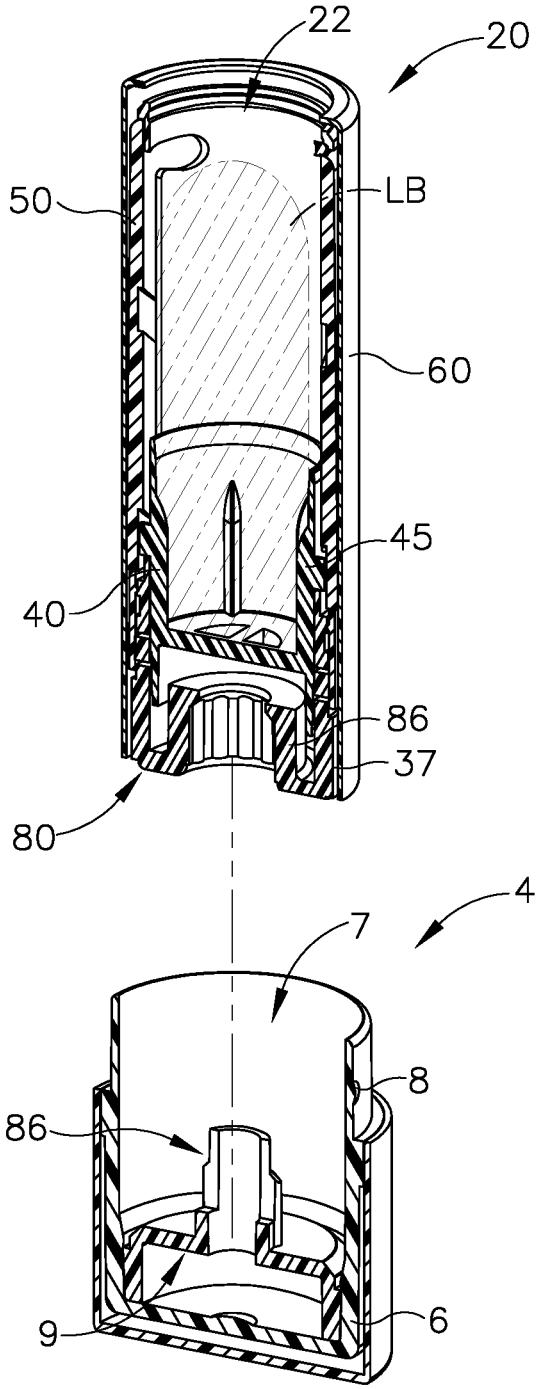
FIG. 5 shows the spiral outer tube, the slotted inner tube, and the lipstick cup assembled into the refill lipstick cartridge, and the lower case.

Referring to the drawings, wherein like reference numerals represent like elements, there is shown in FIGS. 1 through 5, a lipstick product 1 comprising a cover 2 and a lower case 4, and a refill lipstick cartridge 20 for securing and dispensing a lipstick bullet (LB, shown in silhouette in FIG. 5). The cover 2 includes a cover body 3 and an outer cover sleeve 5. As shown in FIG. 1, a lower end of the refill lipstick cartridge 20 is adapted to be disposed within the lower case 4 that comprises a lower base body 6 and a lower cover sleeve 8.

FIGS. 3 and 4 show a refill lipstick cartridge 20, including a lockable refill dispensing tube 25 comprising a spiral outer tube 50, a slotted inner tube 30 disposed concentrically within the spiral outer tube 50, and a lipstick cup 40 disposed within the slotted inner tube 50. An outer cylindrical sleeve 60, having an upper opening **22*b* and a lower opening, slides over and covers the lockable refill dispensing tube 25. FIG. 4 illustrates a sectional view of the lockable refill dispensing tube 25. Each of the spiral outer tube 50, the slotted inner tube 30, and the lipstick cup 40 share a common axial centerline 100. FIG. 5 shows the lockable refill dispensing tube 25 comprising the spiral outer tube 50, the slotted inner tube 30, and the lipstick cup 40, assembled with the outer cylindrical sleeve 60 into the refill lipstick cartridge 20**.

The spiral outer tube 50 comprises a cylindrical wall 51 having an upper opening **22*a* and an opposed pair of helical grooves 52 formed into the inner surface of the cylindrical wall 51. Typically, the pitch of the two helical grooves 52, shown in FIG. 4, is about one, though can be between about one-half to about two. The pitch is the number of complete circumferential turns of a helical groove 52 along the height of the spiral outer tube 50. The spiral outer tube 50 also comprises an annular lower wall 57, with an annular protrusion 58 extending radially inwardly from an inside surface of the annular lower wall 57. The profile shape of the annular protrusion 58** can be curved or with a ridge, or a raised flattened surface.

The slotted inner tube 30 comprises a cylindrical wall 31 and has an opposed pair of vertical slots 35 formed diametrically opposite one another through the cylindrical wall 31. Each vertical slot 35 is formed between and defined by a pair of opposed slot edges 32. The slotted inner tube 30 is slid into a lower opening defined by the bottom rim 59 of the spiral outer tube 50, and is disposed axially within the spiral outer tube 50. The slotted inner tube 30 also comprises a lower wall 37 extending from the lower portion of the cylindrical wall 31, a bottom base 34 extending inwardly from the lower portion of the lower wall 37, and a refill drive means 80 associated with the bottom base 34 and disposed axially within the slotted inner tube 30.

The lipstick cup 40 has a cylindrical wall 41, a lower base 42, and an opposed pair of pins 45 that extend laterally from the outside surface on diametrically-opposite sides of its cylindrical wall 41. The opposed pins 45 extends through the opposed vertical slots 35 in the slotted inner tube 30, and the distal ends of the pins 45 are disposed within, and carried along, the respective opposed helical grooves 52 of the spiral outer tube 50. Rotation of the slotted inner tube 30 about its axial centerline 100 in one direction, relative to a rotatively-stationary spiral outer tube 50, forces the pins 45 of the lipstick cup 40 to follow the helical grooves 52 and travel upwardly along the vertical slots 35, thereby causing the upper tip of the lipstick bullet LB disposed within the lipstick cup 40 to advance upwardly and to extend through a top opening 22 in the refill lipstick cartridge 20. Rotating the slotted inner tube 30 in an opposite direction, conversely, causes the pins 45 of the lipstick cup 40 to follow the helical grooves 52 and travel downwardly along the vertical slots 35, thereby causing the upper tip of the lipstick bullet LB to retract downwardly into the refill lipstick cartridge 20.

The outer cylindrical sleeve 60 that includes a cylindrical outer wall 61 is fitted over the outside of the spiral outer tube 50, and is secured to the spiral outer tube 50 by a mechanical, friction-fit, or adhesive attachment, i.e. one is not slidably or rotatively adjustable on the other. The outer decorative cylinder 60 can also provide improved aesthetics and product appearance for the refill lipstick cartridge 20.

The refill lipstick cartridge 20 also includes a locking means associated with and between the spiral outer tube 50 and the slotted inner tube 30, to minimize or inhibit, and preferably to prevent, the slotted inner tube 30 from rotating freely within the spiral outer tube 50 in a locked configuration. When the locking means is engaged in the locked configuration, rotating the slotted inner tube 30 also causes rotation of the spiral outer tube 50; or, when holding the spiral outer tube 50 rotatively stationary, the slotted inner tube 30 cannot be rotated. Locking together the spiral outer tube 50 and the slotted inner tube 30 prevents the function of vertically extending and retracting the lipstick cup 40, and with it, the lipstick bullet LB. Conversely, when the locking means is engaged in an unlocked configuration, the slotted inner tube 30 can be rotated freely while holding the spiral outer tube 50 rotatively stationary.

Figure 6:
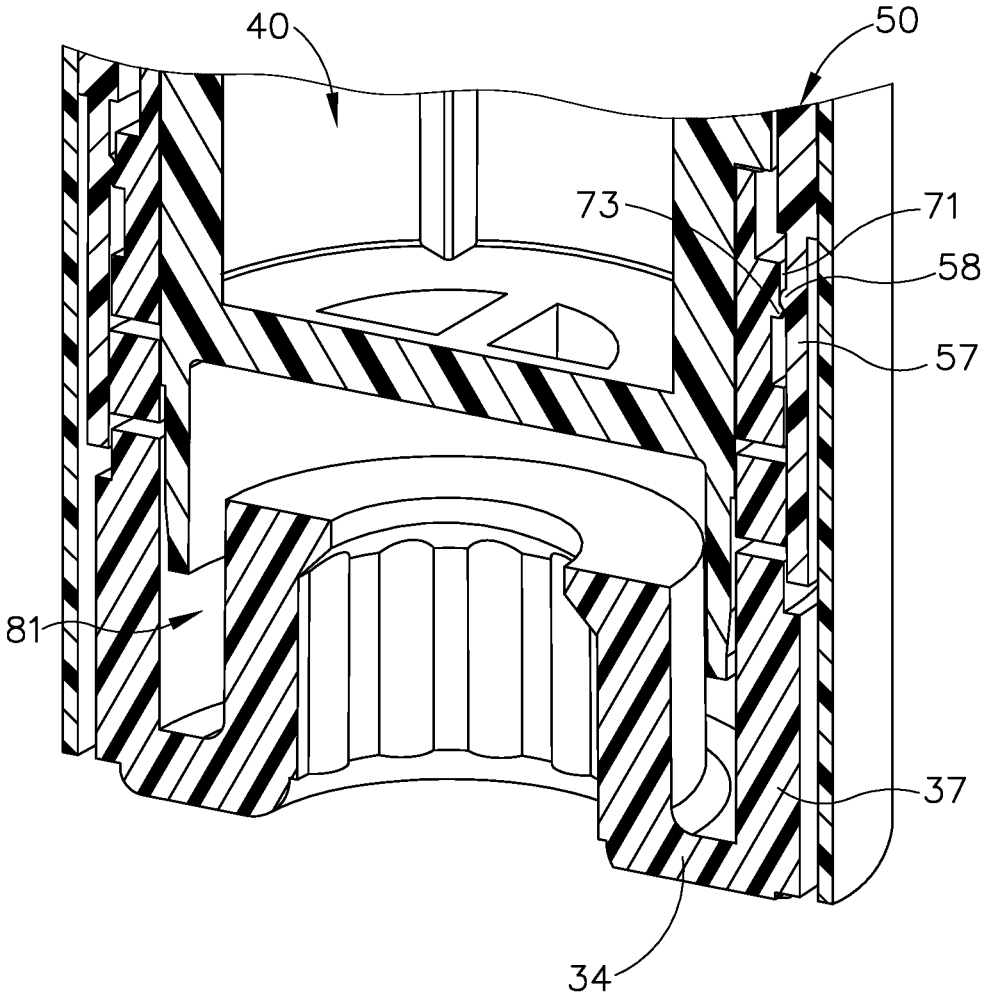
FIG. 6 shows a frictional locking means in the lower end of the refill lipstick cartridge, in a locked configuration.

FIG. 6 shows a frictional locking means that comprises a first frictional locking element, illustrated as an annular protrusion 58 extending radially inwardly from the inside surface of an annular lower wall 57 of the spiral outer tube 50, and a second frictional locking element, illustrated as an annular surface 71, facing radially outwardly on the outer surface of the lower wall 37 of the slotted inner tube 30. The annular protrusion 58 can comprise a single, continuous annular protrusion, or a series of aligned protrusion segments formed into the annular pattern. In various embodiments, the first frictional locking element can also be a helical protrusion that spirals along the inside surface of the annular lower wall 57 of the spiral outer tube 50. The protrusion 58 can have a shape in profile view that is a rounded bump with sides or edges that taper away from the center, upward and downward toward the inner surface of the lower wall 57.

The inwardly-extending annular protrusion 58 of the spiral outer tube 50 overlaps radially the lower wall 37 (and its outer surface) of the slotted inner tube 30, including the annular outer surface 71. Thus, the radial distance of the annular protrusion 58 from the axial centerline 100 is less than the radial distance of the outer surface of the lower wall 37 from the axial centerline 100. In the locked configuration that is illustrated in FIG. 6, and in detail in FIG. 7, the annular protrusion 58 of the spiral outer tube 50 is axially aligned with the annular outer surface 71 of the lower wall 37 of the slotted inner tube 30, with the annular protrusion 58 of the spiral outer tube 50 engaged frictionally with the annular outer surface 71 of the slotted inner tube 30. The frictional engagement between the annular protrusion 58 of the spiral outer tube 50 and the annular outer surface 71 of the slotted inner tube 30, along the entire periphery of the protrusion 58 (or series of protrusion segments, as may be the case), resists, inhibits and/or prevents relative rotation (about the axial centerline 100 and in the peripheral plane of the annular protrusion 58) of the slotted inner tube 30 relative to the spiral outer tube 50. Consequently, in the locked configuration, a user handling the refill lipstick cartridge 20 has some difficulty or substantial difficulty rotating, or cannot rotate, the spiral outer tube 50 (or the outer cylindrical sleeve 60) around the slotted inner tube 30 because of the frictional engagement of the locking means, and will have difficulty to rotate or will not be able to rotate the slotted inner tube 30 within the spiral outer tube 50 without first installing the refill lipstick cartridge into the lower case 4. The amount or degree of frictional resistance to rotation between the annular protrusion 58 of the spiral outer tube 50 and the annular outer surface 71 of the slotted inner tube 30 can be effected in the design of the article using a variety of factors, which can include one or more of the following as non-limiting examples: the material kind of each of the annular protrusion of the spiral outer tube and the annular surface of the slotted inner tube; the breadth (height) of the annular protrusion; the dimensional radial overlap between the first element (the annular protrusion 58) and the second element (the annular surface 71); and the frictional characteristics of the annular outer surface 71 and the annular protrusion 58.

Figure 7:
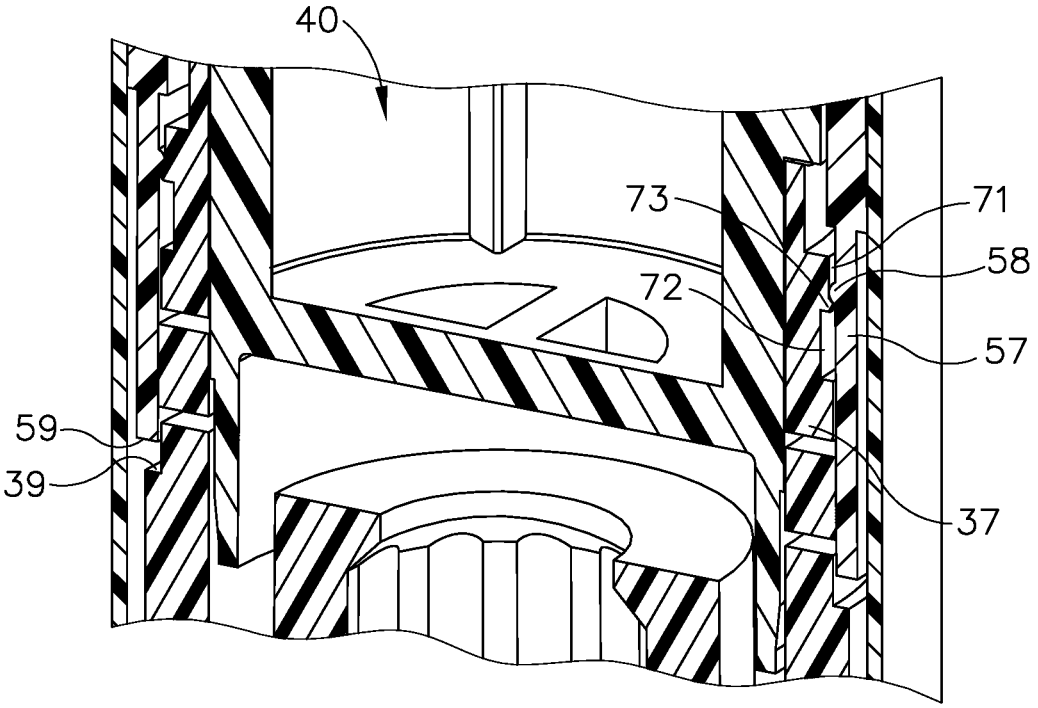
FIG. 7 shows an expanded view of the frictional locking means of FIG. 6 in the locked configuration.
Figure 8:
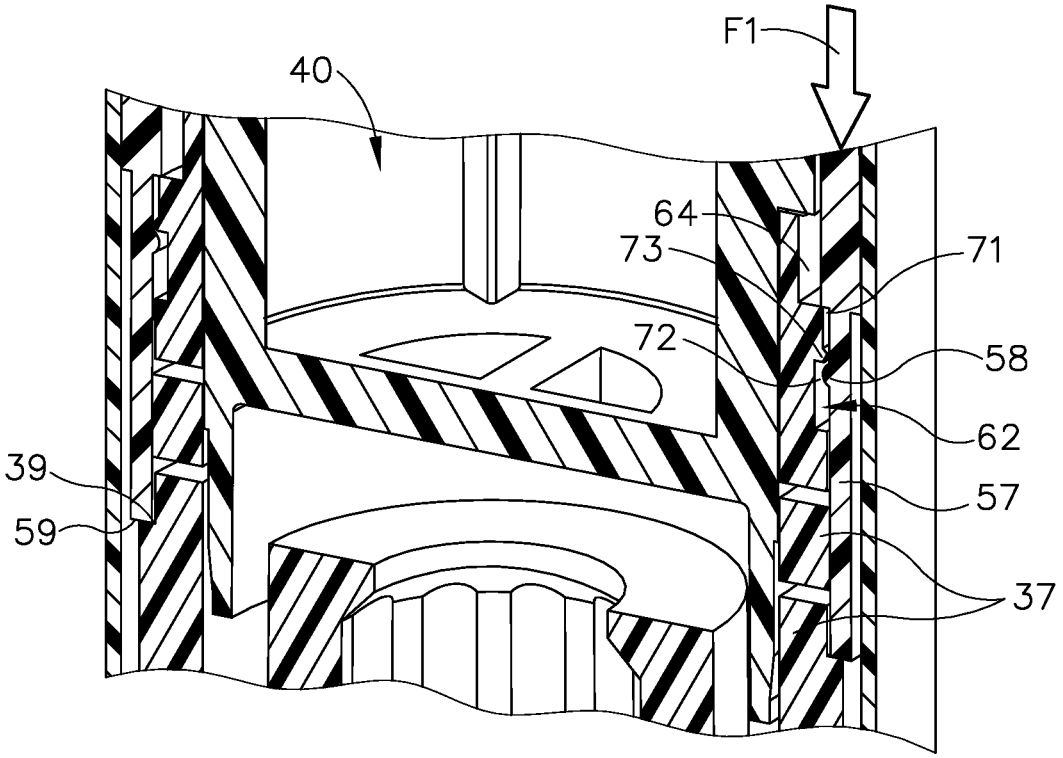
FIG. 8 shows the expanded view of the frictional locking means of FIG. 7 after the frictional locking means is moved into an unlocked configuration.

The refill lipstick cartridge 20 is configured to be manipulated from the locked configuration into an unlocked configuration, preferably as the refill lipstick cartridge 20 is installed into the lower case 4. In the unlocked configuration, the annular protrusion 58 of the spiral outer tube 50 has been displaced axially (downwardly) into a radially-shallower channel 62, formed by a lower annular surface 72 in the lower wall 37 of the slotted inner tube 30 that is more radially inward than the annular outer surface 71, whereby the annular protrusion 58 is disengaged frictionally, and does not radially overlap, the lower annular surface 72 of the lower wall 37. In the illustrated embodiment shown in FIG. 8, a downwardly-directed axial unlocking force, F1, is applied to the spiral outer tube 50 (or the outer cylindrical sleeve 60) while holding steady or restraining the slotted inner tube 30, thereby moving axially the annular protrusion 58 of the spiral outer tube 50 from the first position in frictional engagement with the annular outer surface (friction wall) 71, as shown in FIG. 7, to a second position within the radially-shallower channel 62, and out-of-contact and disengaged with the lower annular surface 72 or any portion of the slotted inner tube 30, as shown in FIG. 8.

In the illustrated embodiment, the annular outer surface 71 of the slotted inner tube 30 includes at its lower rim a radially-outward annular protrusion 73, across which the protrusion 58 must pass down when the unlocking force F1 is applied and the protrusion 58 moved to the unlocked configuration. Otherwise, the radially-distal edge of the radially-outward annular protrusion 73 of the slotted inner tube 30 remains out of engagement or contact with any portion of the inner surface of the annular lower wall 57 of the spiral outer tube 50. The unlocking force F1 can also be termed the unlocking resistance F1 exerted by the protrusion 58 of the device upon the annular outer surface 71 of the slotted inner tube 30 and passing downward beyond the outward annular protrusion 73. In the unlocked configuration, a user handling the refill lipstick cartridge 20 can freely rotate the slotted inner tube 30 within the rotationally-stationary spiral outer tube 50 (or decorative cylinder 60) to operate the refill lipstick cartridge to extend and retract the lipstick bullet.

Figure 9:
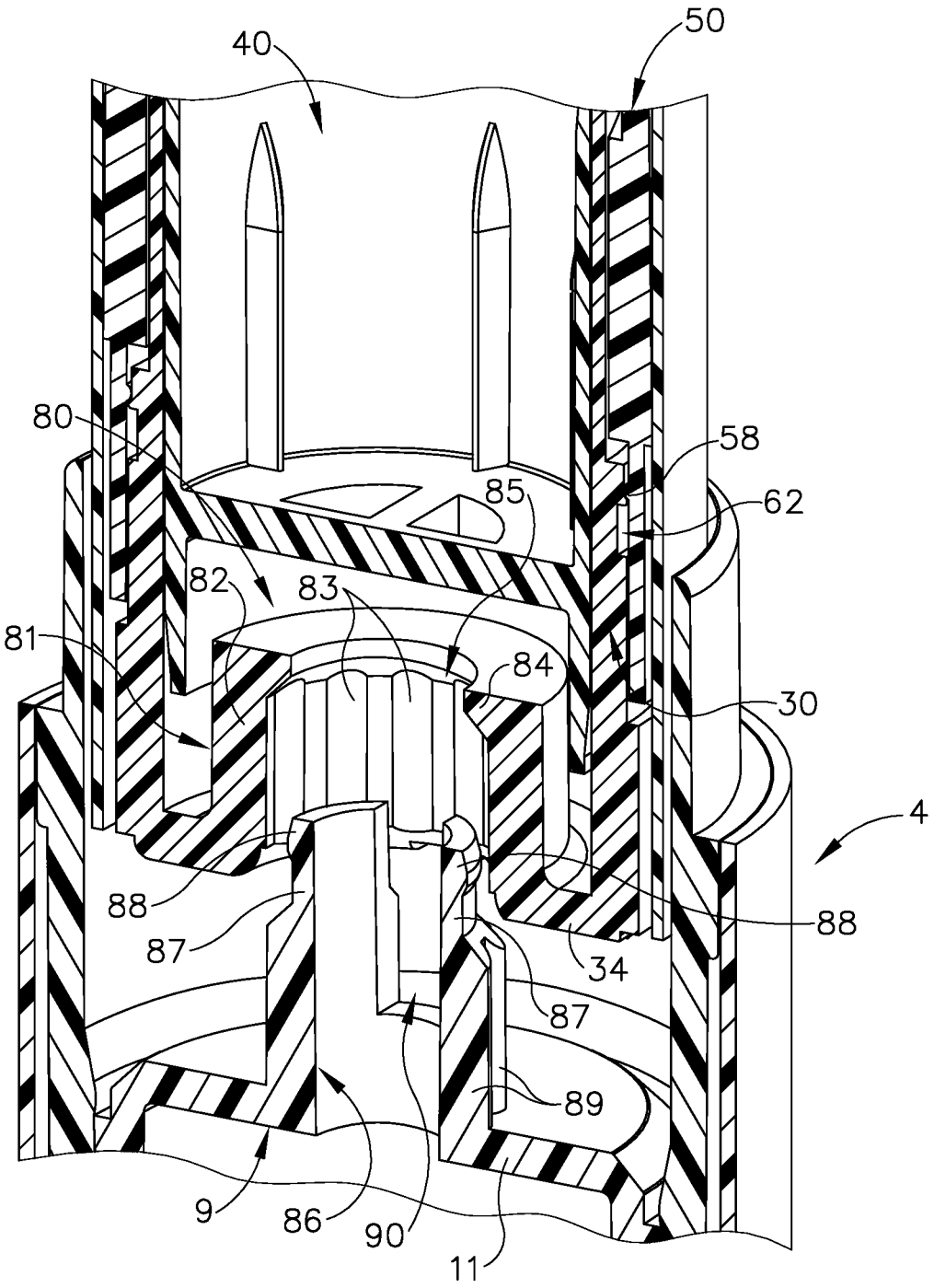
FIG. 9 shows the refill lipstick cartridge in the locked configuration, with a rotation feature of the refill lipstick cartridge being aligned axially with a rotation feature of the lower case.
Figure 10:
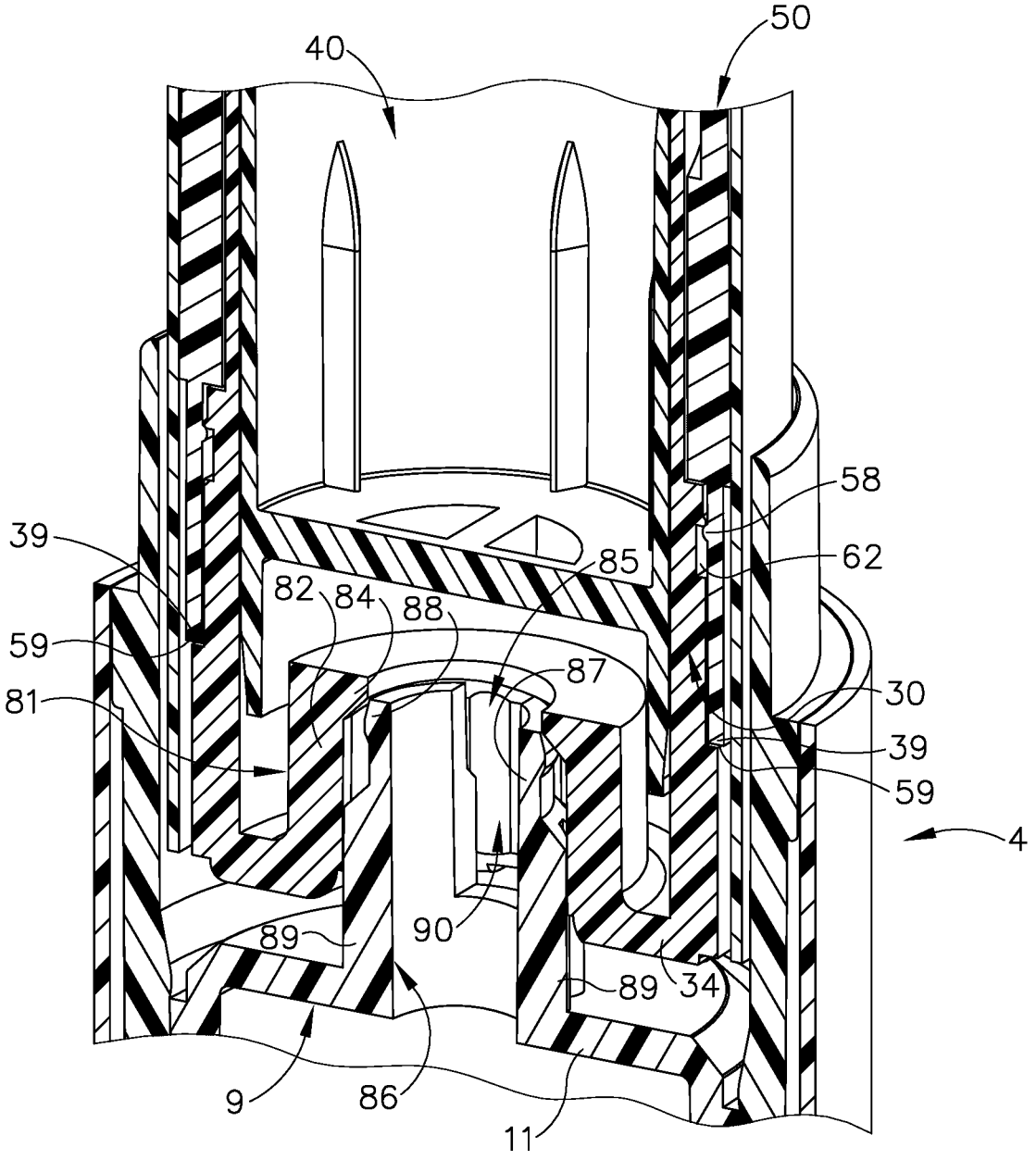
FIG. 10 shows the refill lipstick cartridge of FIG. 9 with a frictional element of its rotation feature being inserted into the lower case and engaging a frictional element of the rotation feature of the lower case, and the frictional locking means of the refill lipstick cartridge moved into the unlocked configuration.

The invention provides a method for adapting the refill lipstick cartridge 20 from the locked configuration to the unlocked configuration when the refill lipstick cartridge 20 is inserted into the lower case 4. FIG. 9 shows the lower end of the slotted inner tube 30 being aligned axially with and positioned into an insertable position within an insertion cavity 7 (labeled in FIG. 5) of the lower case 4, with a refill drive means 80, illustrated as a rounded securing tube 81, registered axially above and around a rounded securing post 86 extending from a floor 11 of a securing base 9 that is positioned within and secured to the lower case 4. The securing base 9 can be secured, for example with an adhesive material or thermal welding, or with a resistive or mechanical securement, such as with a catch or latch. In the illustrated embodiment, the rounded securing tube 81 has a plurality of circumferentially-arranged rounded grooves 83 formed into an inner surface of the tube wall 82, and the rounded securing post 86 includes a corresponding plurality of circumferentially-arranged rounded teeth 89 facing outwardly from the post wall, which are configured to register with and engage into 4500.0.0 the plurality of rounded grooves 83 when the refill lipstick cartridge 20 is inserted into the lower case 4, as shown in FIG. 10.

In an alternative embodiment, the rounded securing tube 81 can include a plurality of peripherally-arranged, inwardly-extending teeth, and the rounded securing post 86 can have a plurality of peripherally-arranged rounded grooves which can register with and be engaged by the inwardly-extending teeth. It can also be understood that the ridges that define and separate the grooves 83 of the securing tube 81 can be in effect "teeth", and that the gaps between the rounded teeth 89 of the securing post 86 can be in effect "grooves". While the teeth and mating or congruent grooves are shown rounded, the surfaces of the teeth and grooves can be planar, and can include two, three, four or more planar faces arranged in any geometric shape. Preferably the number and circumferential spacing of the grooves and the teeth are uniformly oriented and angled around the circumference of the rounded securing tube and securing post, to allow the securing tube 81 to engage with the securing post 86 in any angular orientation to the two members.

A securing tube of the refill drive means 80 and the securing post of the securing base 9 can comprise any geometrically congruent or mating shape, such that manual rotation of the lower case 4 drives or rotates of the slotted inner tube 30. The geometrically-shaped posts and securing tubes can be any regular or irregular shape, including triangular, square, pentagonal or other six-or-more sides shape. The shapes can have linear edges, or rounded edges, such as an oval or three-or-more radially extending lobes. Almost any shape other than a perfect circle is suitable. Preferably, the shapes are congruent and radially regular, so that the post will engage the securing tube in most rotation orientations.

The refill drive means 80 can also include a refill securing means for temporary securement of the refill lipstick cartridge 20 into the lower base 4. In the illustrated embodiment, the securing tube 81 includes an inwardly-extending upper lip 84 that forms a central opening 85. The securing post 86 includes a pair of diametrically-opposed upper walls 87 and an outwardly-projecting rim 88 extending radially outward from an upper end of each of the upper walls 87. The upper walls 87 have an outer curvature corresponding to the inner curvature of the securing tube 81. A pair (at least) of opposed, wide slots 90 separate the two opposed upper walls 87 along the outer circumference of the securing post 86, which allow the opposed pair of upper walls 87, and with them the outwardly-projecting rims 88, to flex radially inwardly and resiliently. The outer periphery of the rim(s) 88 of the securing post 86 have an upper beveled surface and a lower beveled surface, and have a diameter (or largest dimension) greater than the inner periphery of the upper lip 84 of the securing tube 81 that defines opening 85.

As the lower end of the slotted inner tube 30 slides axially downward into the insertion cavity 7, the upper rim(s) 88 of the securing post 86 extend upwardly into the interior space of the securing tube 81, until the upper beveled surfaces of the outwardly-projecting rims 88 engage the beveled underportions of the inwardly-extending upper lip 84 of the securing tube 81, as shown in FIG. 10, interfering with further free movement of the securing post 86 upward and through the opening 85 of the securing tube 81.

Figure 11:
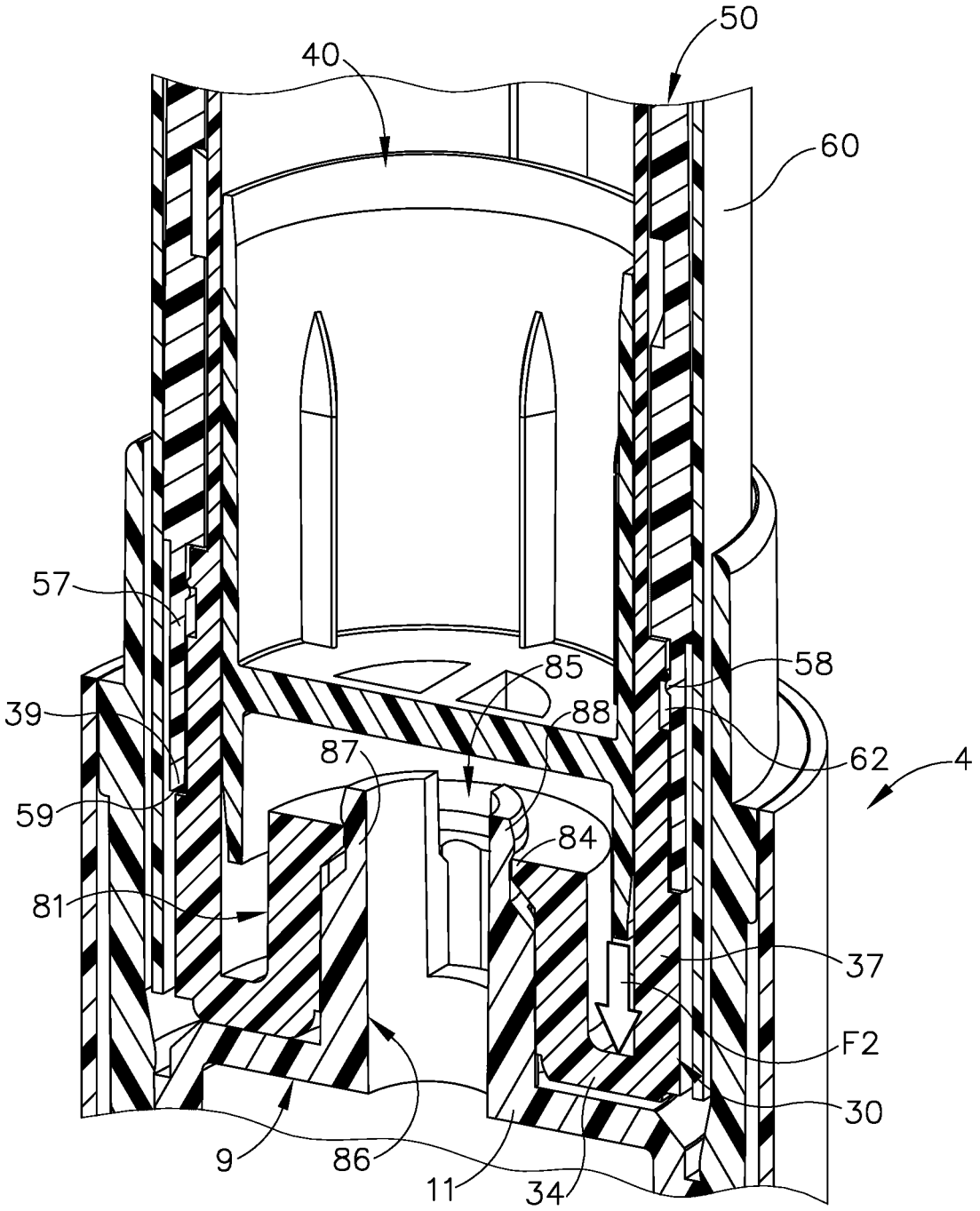
FIG. 11 shows the refill lipstick cartridge and lower case of FIG. 10, after the refill lipstick cartridge in the unlocked configuration has been inserted fully and secured into the lower case.

In order to move the securing tube 81 further into temporary securement with the securing post 86, an insertion force F2, as shown in FIG. 11, is needed to overcome the frictional resistance and obstruction by the inwardly-extending upper lip 84 of the securing tube 81 against the insertion of the opposed pair of outwardly-projecting rims 88 of the securing post 86 through the central opening 85 of the securing tube 81. The insertion force F2 is typically applied to the refill lipstick cartridge 20 by grasping the cylindrical sides of, or pushing down in the top end of, the outer sleeve 60. To transfer the force F2 from the outer sleeve 60 to the securing tube 81 of the slotted inner tube 30, a bottom rim 59 in the wall 57 of the spiral outer tube 50 (to which the outer sleeve 60 is fixed) confronts an outwardly-extending annular shoulder 39 in the lower wall 37 of the slotted inner tube 30, as shown in FIGS. 8 and 10, thereby transferring the axially-directed force F2 onto the slotted inner tube 30 and to the securing tube 81. The bottom rim 59 in the spiral outer tube 50 provides an undercut, downward-facing surface. The annular shoulder 39 in the lower wall 37 of the slotted inner tube 30 provides an outwardly-extending, upward-facing surface that radially overlaps with the undercut, downward-facing surface of the bottom rim 59. When the spiral outer tube 50 moves axially to the unlocked position, the undercut, downward-facing surface of the bottom rim 59 confronts and is stopped by outwardly-extending annular shoulder 39 in the lower wall 37. It is noted that a vertical, longitudinal clearance is provided between the bottom rim 59 of the spiral outer tube 50 and the annular shoulder 39 of the slotted inner tube 30 when the locking means is in the locked configuration, as shown in FIG. 7. In various embodiments, the spiral outer tube 50 can include any other undercut annular surface in the wall 57 that is radially overlapping with and can engage any other outwardly-extending annular shoulder in the lower wall 37 of the slotted inner tube 30, after the locking means has been moved from the locked configuration to the unlocked configuration, so that the downward force F2 applied to the spiral outer tube or the outer sleeve, is transferred to the slotted inner tube and the securing tube.

The insertion force F2 results in a radially-inward biasing force onto the opposed pair of rims 88, causing the opposed pair of rims 88 to flex radially inwardly until the upper beveled surfaces of the outwardly-projecting rims 88 can pass upwardly and into the central opening 85 of the securing tube 81. The insertion force F2 can also be termed the insertion resistance F2 of the device. Once the upper and lower beveled surfaces of the outwardly-projecting rims 88 have passed completely through the central opening 85, the biasing force radially-inward on the opposed pair of rims 88 is released, and the resilience of the material of the flexed pair of rims 88 returns the upper walls 87 outwardly to their relaxed or unbiased positions, with the lower beveled surfaces of the rims 88 disposed axially about the upper surface of the securing tube 81, with the upper walls 87 of the securing post 86 disposed axially within the central opening 85 of the securing tube 81. The securing post 86 is now fully inserted into a temporary securement position within the securing tube 81. In this position, teeth 89 of the securing post 86 are in register with and engage with grooves 83 of the securing tube 81, for rotationally driving the securing tube 81 with the securing post 86.

After the refill lipstick cartridge 20 is temporarily secured into lower case 4, the lower beveled surfaces of the outwardly-extending rims 88 confront the upper surface of the inwardly-extending upper lip 84 of the securing tube 81, and inhibit withdrawal of the refill lipstick cartridge 20 upward out of the insertion cavity 7 of the lower case 4.

In an embodiment of the invention, the unlocking force F1 (the force needed to move from the locked configuration in FIGS. 7 and 8 to the unlocked configuration in FIGS. 8 and 9) is a force less than the insertion force F2, the force needed to temporarily secure the refill lipstick cartridge 20 into the lower base 4.

In various embodiments, the force F1 is at least about 1 kilogram force (kgf), and can be up to about 5 kgf. In an embodiment, the force F2 is at least about 2 kgf, and can be up to about 10 kgf. In an embodiment of the invention, the force F1 is typically about 1.5 to 2.0 kilograms force (kgf), and the force F2 is typically about 30 to 50 kgf. In another embodiment, the ratio of the force F2 to the force F1 is about 1.5 to about 3.

Figure 12:
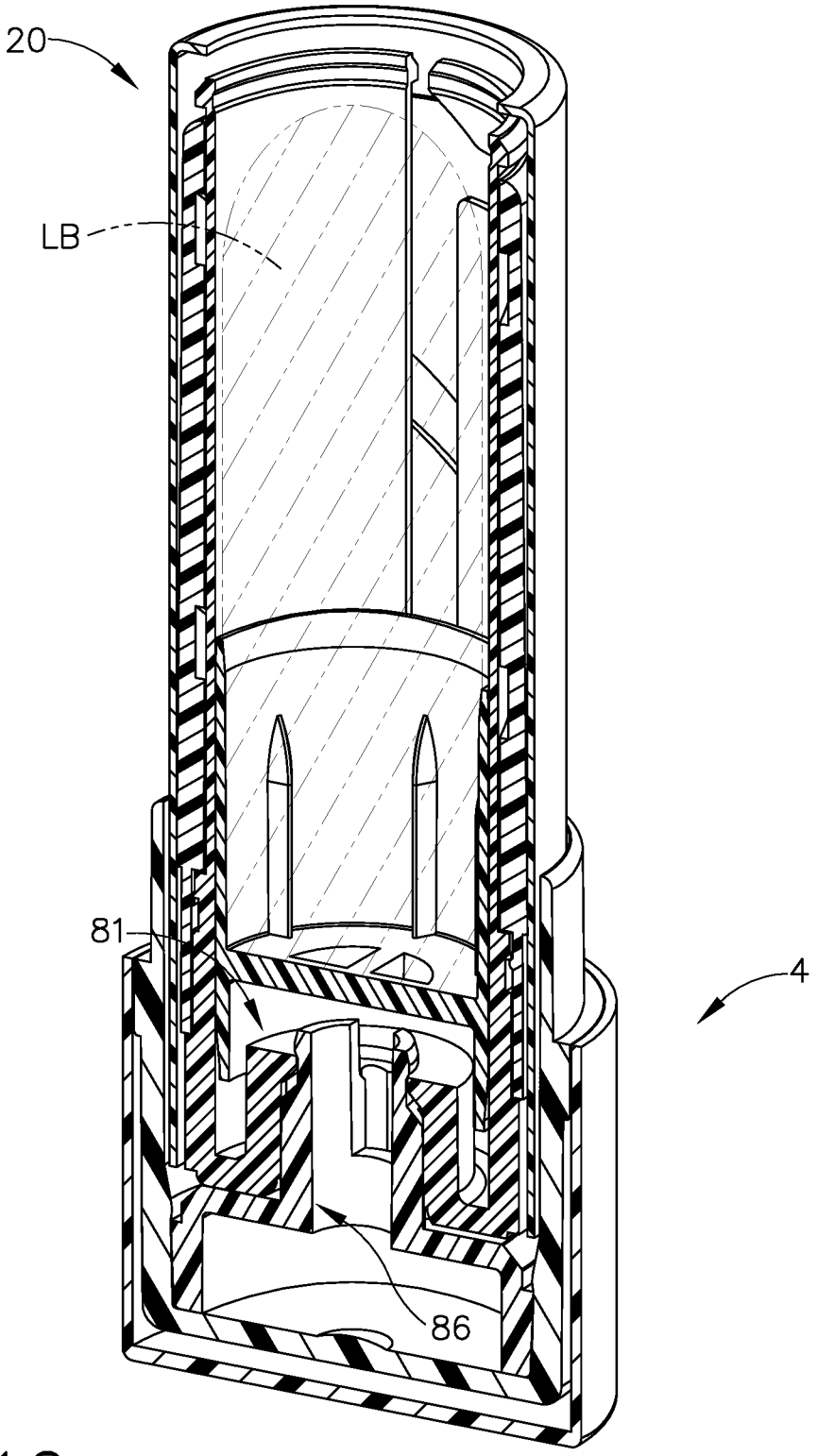
FIG. 12 shows the lipstick product dispenser with the inserted and secured refill lipstick cartridge in the lower case.

The lipstick is then used as any typical lipstick product is used, in the unlocked configuration, by rotating the spiral outer tube 50 to extend the lipstick bullet for application by the user, and to retract the lipstick bullet for storage, as shown in FIG. 12.

Figure 13:
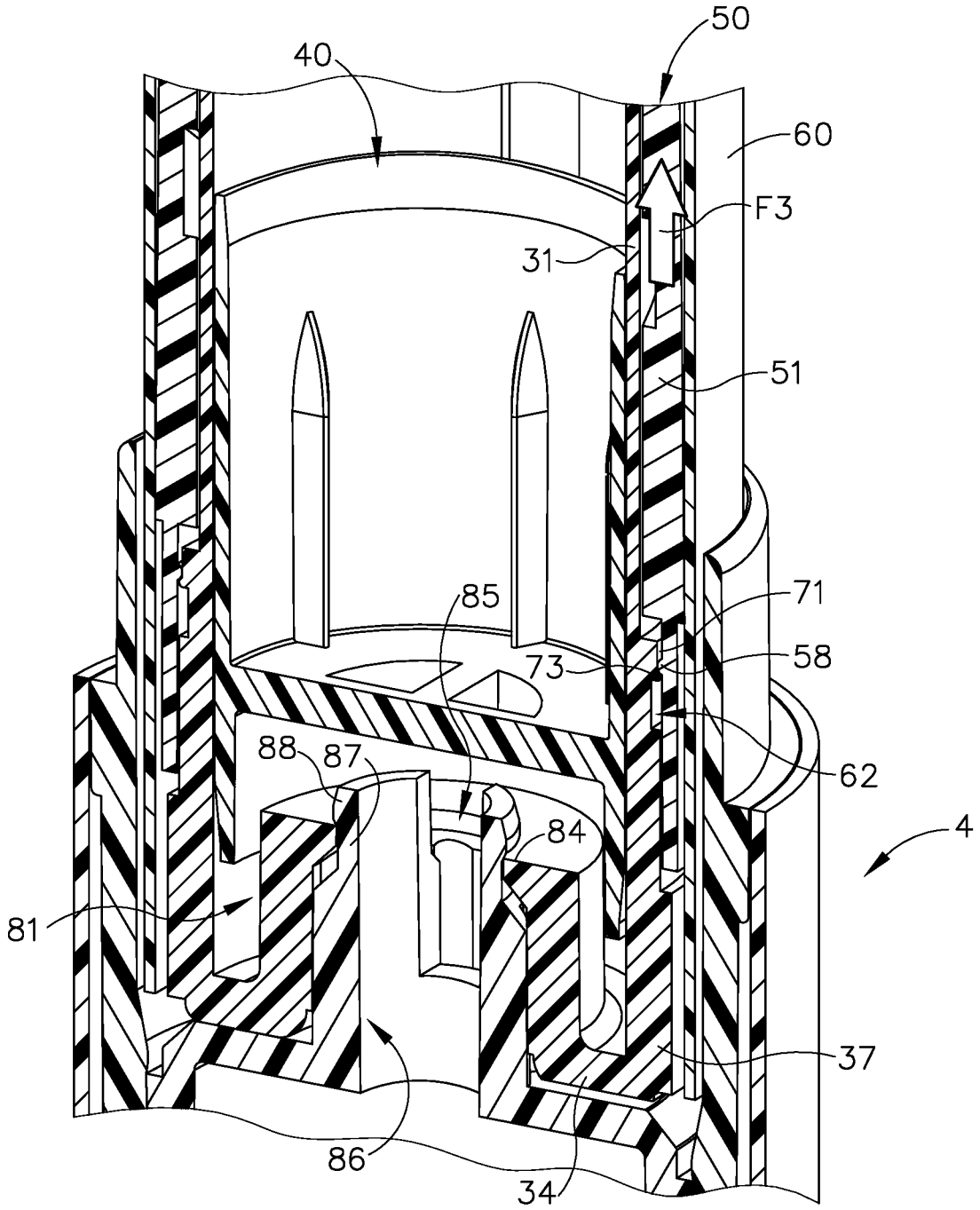
FIG. 13 shows the refill lipstick cartridge in the inserted position of FIG. 12 within the lower case, after the refill lipstick cartridge is manipulated to move the frictional locking means into the locked configuration.
Figure 14:
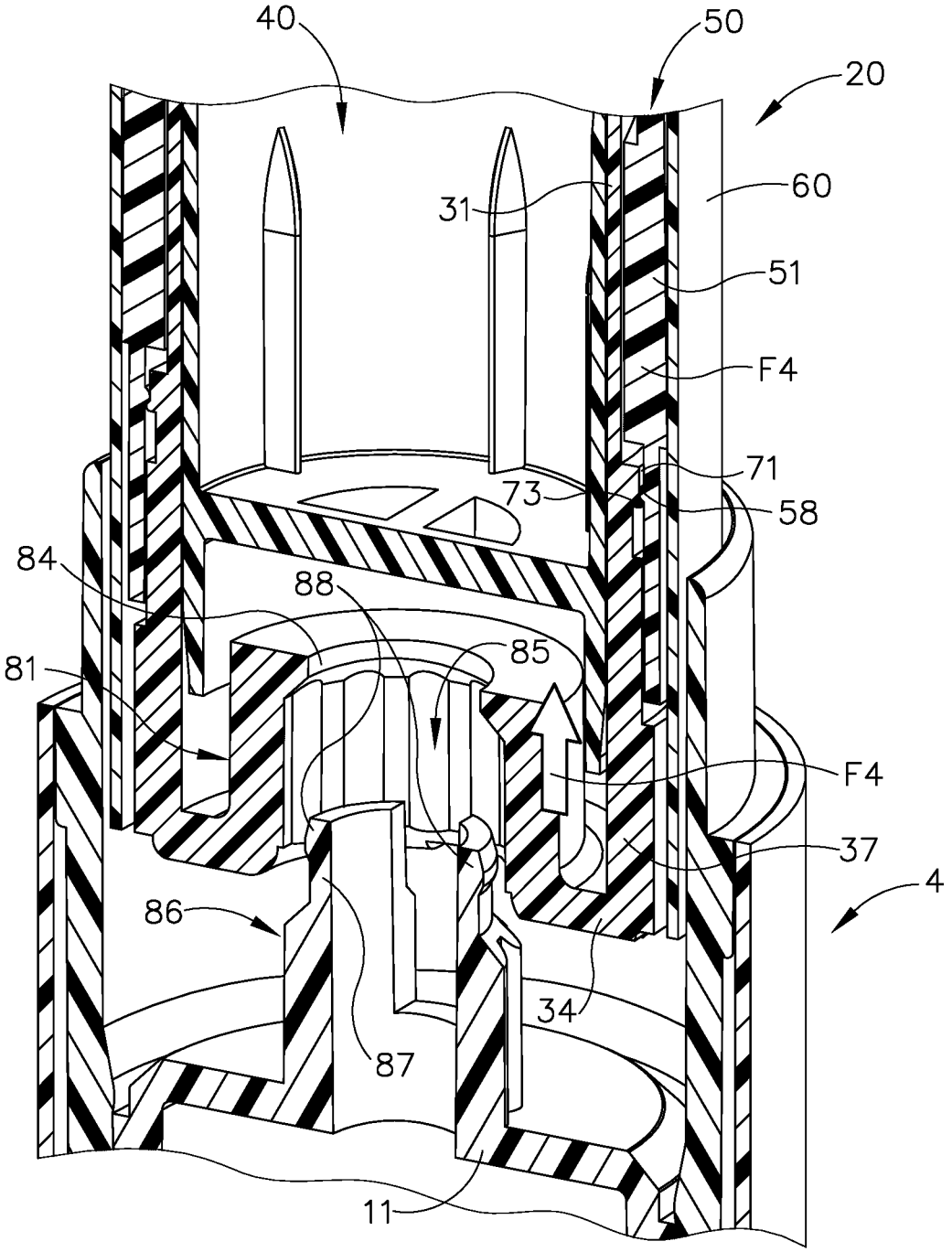
FIG. 14 shows the refill lipstick cartridge in the locked configuration, being extracted from the lower case.

When the lipstick has been exhausted, and the exhausted refill lipstick cartridge 20 needs to be removed, the securing post 86 of the lower case 4 is withdrawn from the securing tube 81 of the refill lipstick cartridge 20. The user grasps the spiral outer tube 50 (or the outer cylindrical sleeve 60) and pulls upwardly and axially in order to apply an upwardly-directed force onto the refill lipstick cartridge 20, to withdraw the exhausted refill lipstick cartridge 20 from the lower base 4. Concurrently, the upward force applied to the spiral outer tube 50 also acts upon the locking means in the unlocked configuration shown in FIG. 11, to move axially the annular protrusion 58 of the spiral outer tube 50 from within the channel 62 of the slotted inner tube 30, over the outwardly-extending annular protrusion 73, and into axial alignment and frictional engagement with the annular surface 71 of the slotted inner tube 30, and thus back to the locked configuration, as shown in FIG. 13. The upwardly-directed axial locking force, F3, to move the locking means from the unlocked configuration to the locked configuration, is typically about the same magnitude as the unlocking force, F1, in the opposite direction. The locking force F3 can also be termed the locking resistance F3 of the device.

Concurrently, an upwardly-directed extraction force. F4, required to remove the securing tube 86 from the securing tube 81, is typically about the same magnitude as the insertion force, F2, in the opposite direction. The upwardly-directed extraction force, F4, upon the exhausted refill lipstick cartridge 20, and therewith upon the securing tube 81, is applied by the upper surface of the securing tube 81 upon the lower beveled surfaces of the rims 88, causing the opposed pair of rims 88 to flex radially and resiliently inwardly until the lower beveled surfaces of the outwardly-projecting rims 88 can pass downward into and through the central opening 85 of the securing tube 81. Once outwardly-projecting rims 88 pass through the central opening 85, the biasing force radially-inward on the opposed pair of rims 88 is released, the resilience of the material of the flexed pair of rims 88 returns the upper walls 87 outwardly to their relaxed or unbiased positions, and the exhausted refill lipstick cartridge 20, with the locking means still in the locked configuration, is freely removed from the lower case 4.

The extraction force F4 can also be termed the extraction resistance of the device. Typically, the upward locking force (resistance) F3 is less than the upward extraction force (resistance) F4, so consequently, when the user applies the upward force to withdraw the exhausted refill lipstick cartridge 20 from the lower base 4, the frictional locking means is first positioned into the locked configuration, before the exhausted refill lipstick cartridge 20 is removed from the lower case 4.

In an embodiment, the force F3 is at least about 1 kilogram force (kgf), and can be up to about 5 kgf. In an embodiment, the force F4 is at least about 2 kgf, and can be up to about 10 kgf. In an embodiment of the invention, the force F3 is typically about 1.5 to 2.0 kilograms force (kgf), and the force F4 is typically about 30 to 5.0 kgf. In another embodiment, the ratio of the force F4 to the force F3 is about 1.5 to about 3.

In an alternative embodiment, understood by a person of ordinary skill, the invention provides for other locking and unlocking features for manipulating the refill lipstick cartridge between the locked configured and the unlocked configuration. In one embodiment, the annular protrusion instead can extend radially outwardly from an outer surface of the slotted inner tube 30 to engage an annular inner surface of the spiral outer tube 50 when in a locked configuration, and then into a radially-outward channel in an inner surface of the spiral outer tube 50 when in an unlocked configuration. The unlocking force F1 and locking force F3 requirements of such alternative embodiment can be substantially the same.

Alternative refill securing means are intended by and covered in the present invention. In an alternative embodiment, understood by a person of ordinary skill, inwardly-protruding ridges can be positioned on the inside surfaces of the peripheral wall of the securing tube, and vertical recesses formed into the outer surfaces of the vertical post. The insertion force F3 and extraction force F4 requirements of such alternative embodiment can be substantially the same.

Figure 15:
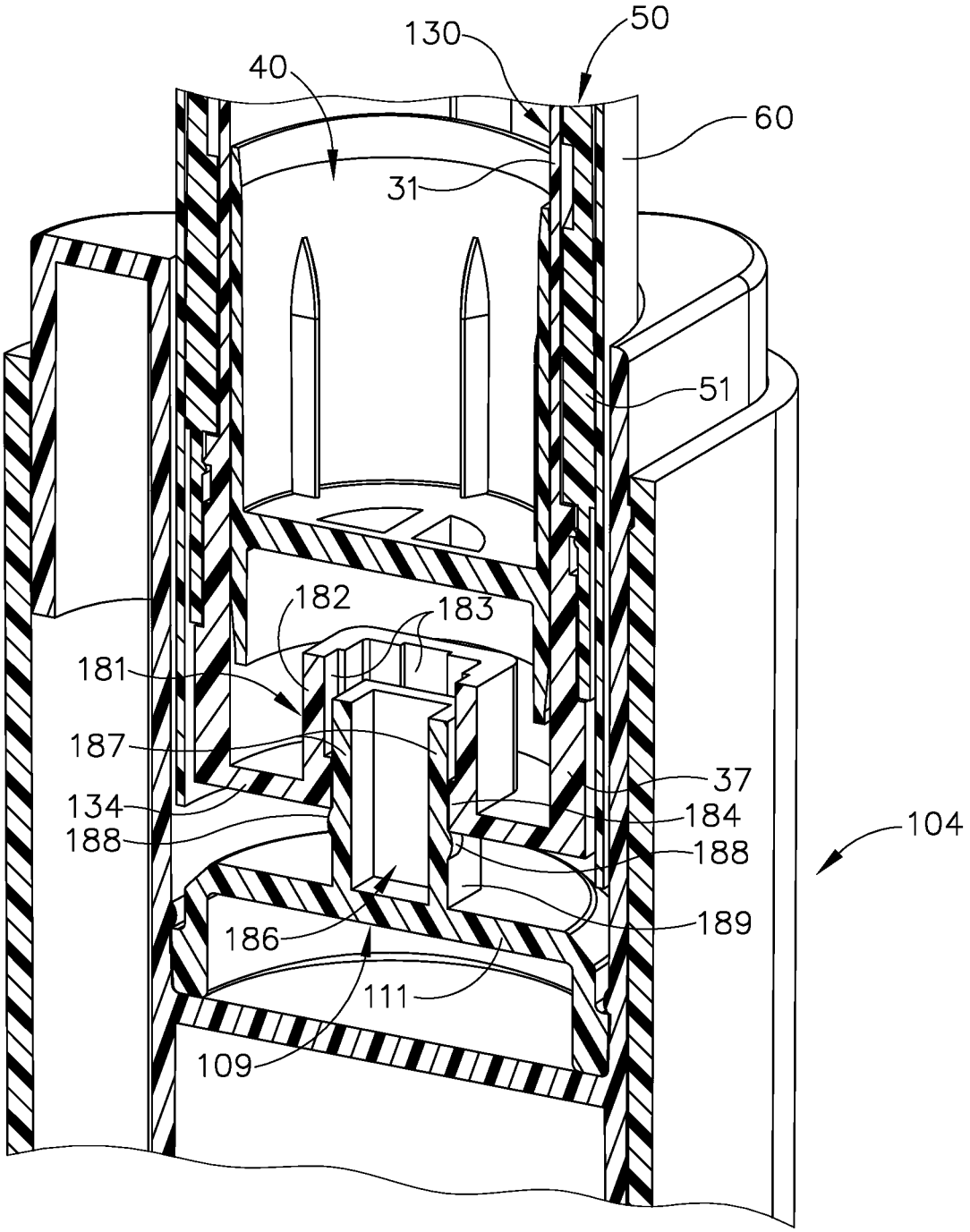
FIG. 15 shows a refill lipstick cartridge and the lower case having alternative rotation features, with a frictional element of its rotation feature being inserted into the lower case and engaging a frictional element of the rotation feature of the lower case, and the frictional locking means of the refill lipstick cartridge moved into the unlocked configuration.

FIG. 15 shows an alternative, non-limiting embodiment of a refill drive means 180 for temporary securement of a refill lipstick cartridge 20 into a lower base 104. In the illustrated embodiment, the securing tube 181 includes a peripheral wall 182 formed as a square with four wall portions, each of the four wall portions having a lower wall surface 184 extending upward from the bottom 134 of the slotted inner tube 130, with a vertical recess 183 formed into the inner surface above the lower wall surface 184 of each wall portion.

A securing base 109 secured into a lower case 104 includes a square securing post 186 configured for axially insertion inside the square peripheral wall 182 of the securing tube 181. The square securing post 186 includes four wall portions 187, each of the four wall portions having an outer wall surface extending vertically from the base 111 of the securing base 109. The square securing post 186 also includes an outwardly-protruding ridge 188 on one or more, and preferably each, of the outer surface of each wall portion 187 of the square securing post 186. The ridge 188 typically has a raised middle section that tapers at the upper and lower edges to the outer wall surfaces. The lower edge of the ridges 188 is disposed a distance up along the wall portions 187, above the lower wall 189, of about the height of the lower wall surface 184 of the peripheral wall 182 of the securing tube 181. The lateral dimension or distance from the outermost edge of the ridges 188 on opposite wall portions of the peripheral wall 182 is greater than the lateral distance between the inner surfaces of the opposed bottom wall segments 184 of the securing tube 181.

When the refill lipstick cartridge 20 is inserted into a lower base 104, the securing post 186 axially extends into the securing tube 181. In order to move the outwardly-protruding ridges 188 of the securing post 186 into the lower end of the securing tube 181, and to a floor 111 of the securing base 109, an insertion force F2 is needed to overcome the frictional resistance exerted by the outwardly-protruding ridges 188 of the securing post 186 upon the bottom wall segments 184 of the securing tube 181 of the slotted inner tube 130. As in the earlier embodiment, the insertion force F2 is a force greater than an unlocking force F1, needed to move the refill lipstick cartridge from the locked configuration to the unlocked configuration.

Figure 16:
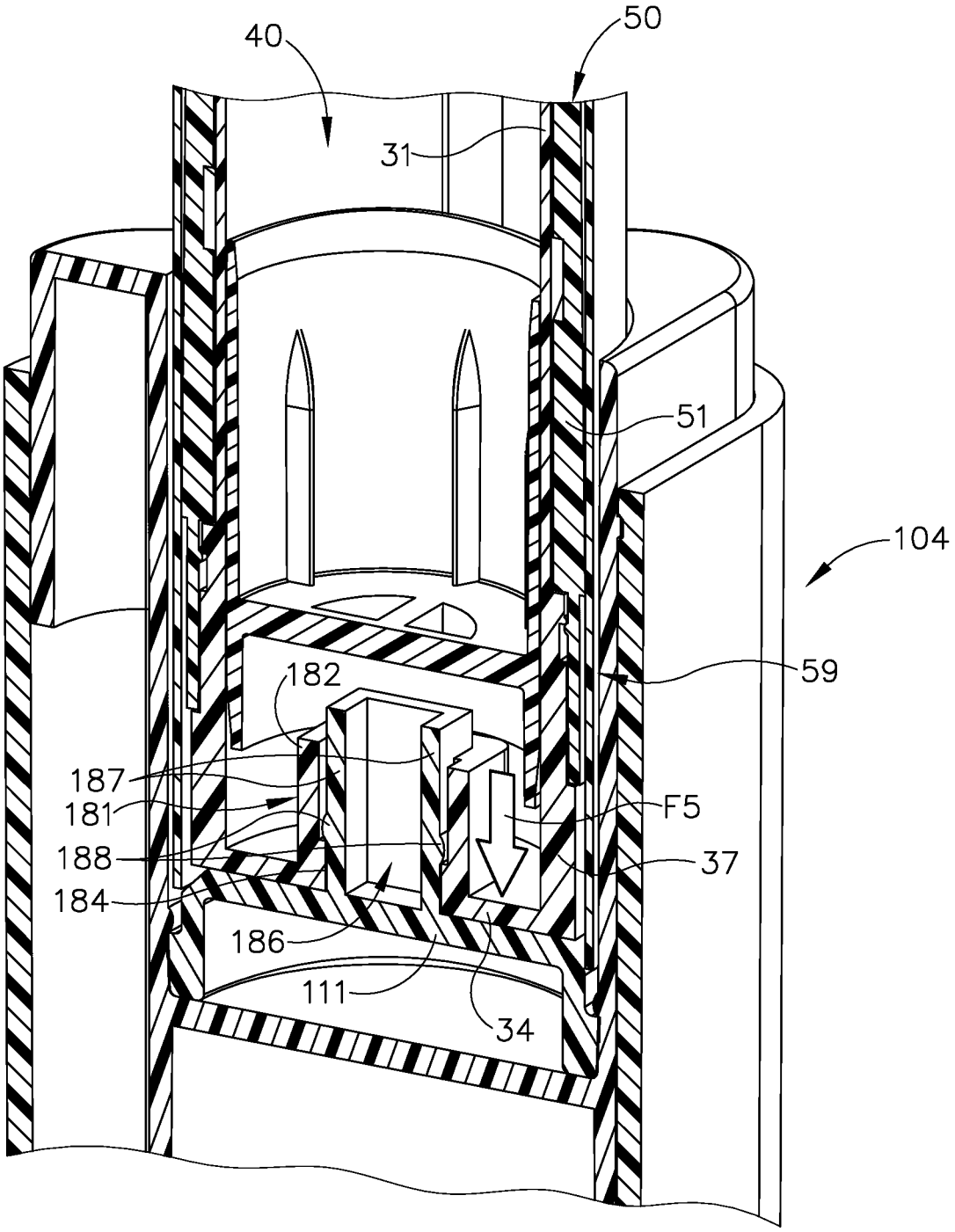
FIG. 16 shows the alternative refill lipstick cartridge and lower case of FIG. 15 after the refill lipstick cartridge is inserted fully and secured into the lower case.

When the slotted inner tube 130 has been inserted fully into the insertion cavity 7 of the lower case 104, as shown in FIG. 16, the bottom wall segments 184 have moved over and beyond the respective ridges 188 into confronting position with the lower walls 189. When disposed within the vertical recess 183, the ridges 188 are substantially out of frictional engagement with the securing tube 181. The insertion force F2 can also be termed the insertion resistance F2 of the device. As illustrated, the positioning vertically of the outwardly-protruding ridges 188 on the securing post 186 is at a vertical distance above the floor 111 that is at least the height of the bottom wall segments 184 of the securing tube 18, sufficient to allow the outwardly-protruding ridges 188 to extend into the vertical recesses 183. That is, the vertical distance of the lower end of the outwardly-protruding ridges 188 from the top surface of the floor 111 of the lower case 104 is at least, and typically the same as, the vertical height of the bottom wall segments 184 of the securing tube 181.

When the lipstick has been exhausted, and the exhausted refill lipstick cartridge needs to be removed, the user grasps the spiral outer tube 50 (or the decorative cylinder 60) of the exhausted refill lipstick cartridge, and pulls upwardly and axially in order to apply an upwardly-directed force onto the refill lipstick cartridge 20, to withdraw the exhausted refill lipstick cartridge 20 from the lower base 104. Concurrently, the upward force applied to the spiral outer tube 50 first moves the locking means with a first force F3 to the locked configuration. A further and greater upwardly-directed extraction force, F4, withdraws the securing tube 181 from the securing post 186, the extraction force F4 being about the same magnitude as the insertion force, F2, in the opposite direction.

Figure 17:
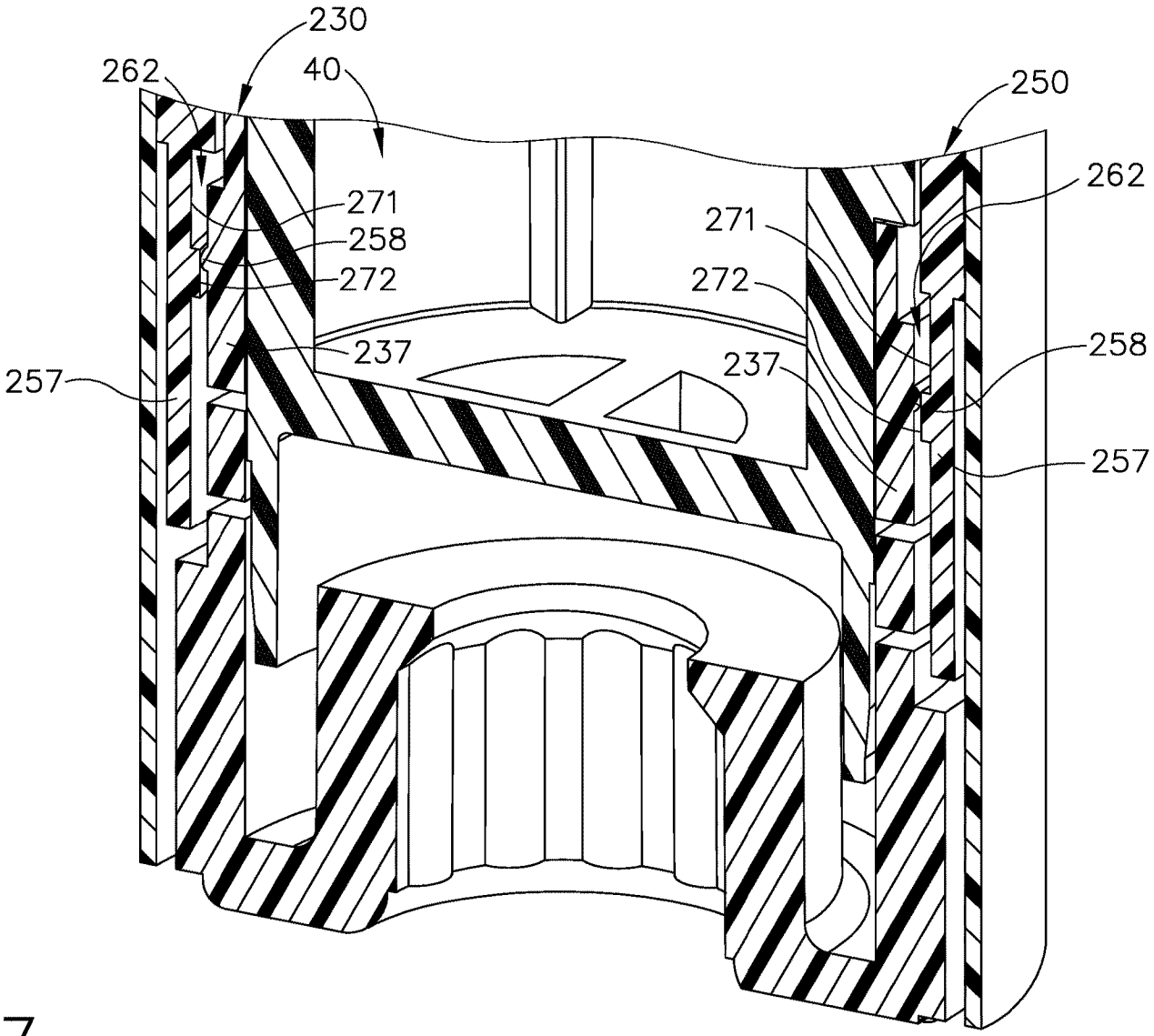
FIG. 17 shows a sectional view of an alternative embodiment of a frictional refill lipstick cartridge, in the locked configuration.
Figure 18:
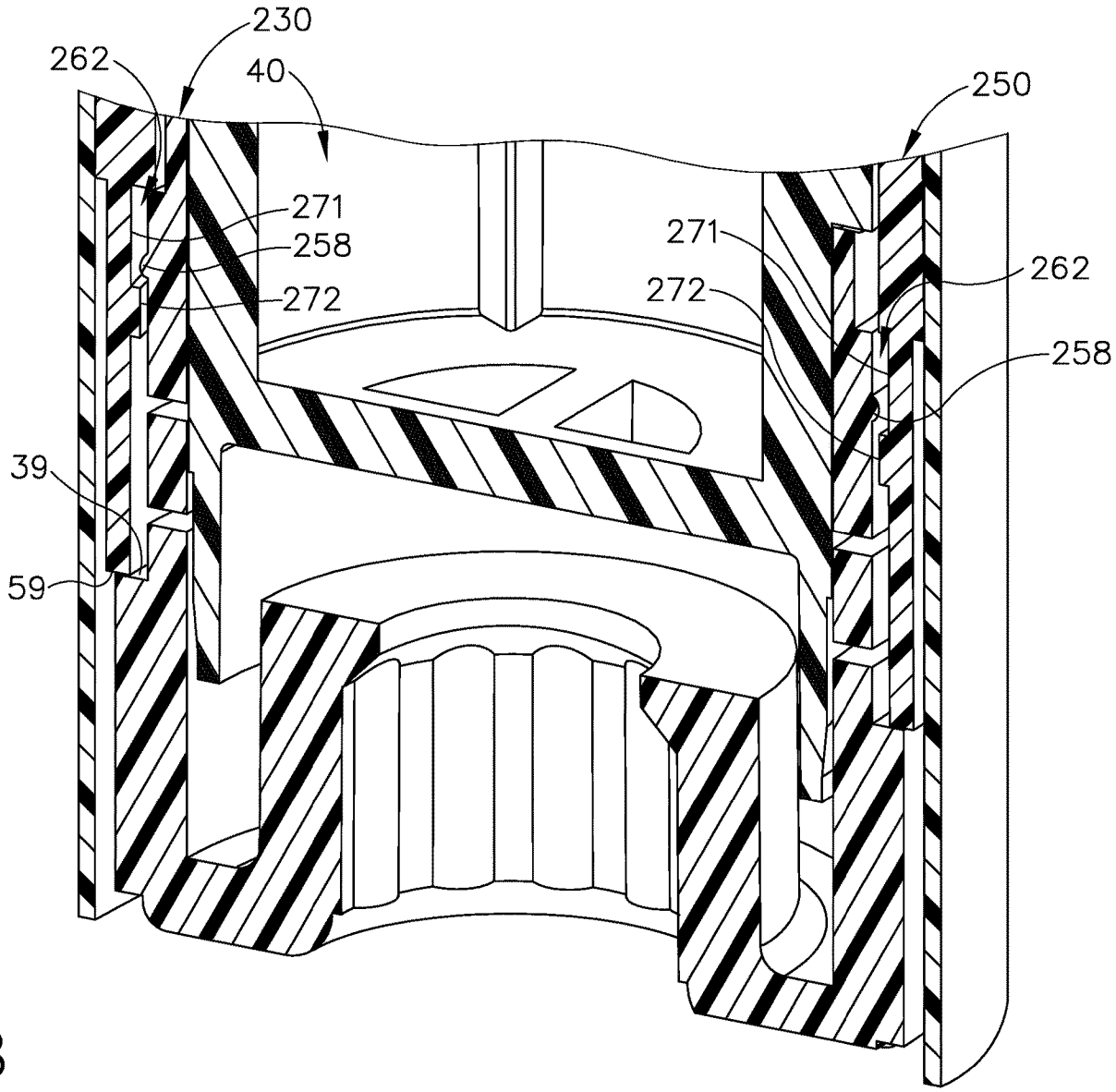
FIG. 18 shows the alternative embodiment of the refill lipstick cartridge of FIG. 17, in the unlocked configuration.

An alternative embodiment of a frictional locking means for the refill lipstick cartridge is shown in FIGS. 17 and 18. In FIG. 17, a slotted inner tube 230 is positioned in a locked position with a spiral outer tube 250. In this embodiment, the frictional locking means comprises a first element, illustrated as an annular protrusion 258 extending radially outwardly from an outside surface of the annular lower wall 237 of the slotted inner tube 230, and a second element, illustrated as an annular surface 271, facing radially inwardly on the inner surface of the lower wall 257 of the spiral outer tube 250. As in the earlier embodiment, the annular protrusion 258 can comprise a single, continuous annular protrusion, or a series of aligned protrusion segments formed into the annular pattern. In various embodiments, the first element can also be a helical protrusion that spirals along the outside surface of the annular lower wall 237 of the slotted inner tube 230. The protrusion 258 can have a shape in profile view that is a rounded bump with sides or legs that taper away from the center, upward and downward toward the outer surface of the lower wall 237.

The outwardly-extending annular protrusion 258 overlaps radially the lower wall 257 and its inner surface, including the annular inner surface 271. Thus, the radial distance of the annular protrusion 258 from the axial centerline 100 is greater than the radial distance of the annular inner surface 271 of the lower wall 257 from the axial centerline 100. In the locked configuration illustrated in FIG. 17, the annular protrusion 258 of the slotted inner tube 230 is axially aligned with the annular inner surface 271 of the lower wall 257 of the spiral outer tube 250, with the annular protrusion 258 of the slotted inner tube 230 engaged frictionally with the annular surface 271 of the spiral outer tube 250. The frictional engagement between the annular protrusion 258 of the slotted inner tube 230 and the annular surface 271 of the spiral outer tube 250, along the entire periphery of the protrusion 258 (or series of protrusion segments, as may be the case), resists, inhibits and/or prevents relative rotation (about the axial centerline 100 and in the peripheral plane of the annular protrusion 258) of the spiral outer tube 250 relative to the slotted inner tube 230. Consequently, in the locked configuration, a user handling the refill lipstick cartridge 20 has some difficulty or substantial difficulty rotating, or cannot rotate, the spiral outer tube 250 (or the outer cylindrical sleeve 60) because of the frictional engagement of the locking means, and will have difficulty to rotate or will not be able to rotate the slotted inner tube 230 within the spiral outer tube 250 without first installing the refill lipstick cartridge into the lower case 4. The amount or degree of frictional resistance to rotation between the annular protrusion 258 of the slotted inner tube 230 and the annular surface 271 of the spiral outer tube 250 can be effected in the design of the article using a variety of factors, which can include one or more of the following as non-limiting examples: the material kind of each of the annular protrusion of the spiral outer tube and the annular surface of the slotted inner tube; the breadth (height) of the annular protrusion; and the dimensional radial overlap between the first element (the annular protrusion 358) and the second element (the annular surface 371).

As in the earlier embodiment, the refill lipstick cartridge 20 is configured to be manipulated from the locked configuration into an unlocked configuration, preferably as the refill lipstick cartridge 20 is installed into the lower case 4. From the illustrated embodiment shown in FIG. 17, a downwardly-directed axial unlocking force is applied to the spiral outer tube 250 (or the outer cylindrical sleeve 60) while holding steady or restraining the slotted inner tube 230, thereby moving axially the annular inner wall 271 (friction wall) of the spiral outer tube 250 from the first position in frictional engagement with the annular protrusion 258 of the slotted inner tube 230, to a second unlocked position that is axially out-of-contact and disengaged from the annular protrusion 258. In the unlocked configuration, shown in FIG. 18, the annular protrusion 258 of the slotted inner tube 230 has been displaced axially into a radially-deeper channel 262, formed by an annular surface 272 in the lower wall 257 of the spiral outer tube 250 that is more outward radially than the annular surface 271, whereby the annular protrusion 258 is disengaged frictionally, as well as mechanically, from the annular surface 271 of the lower wall 257 of the spiral outer tube 250.

Figure 19:
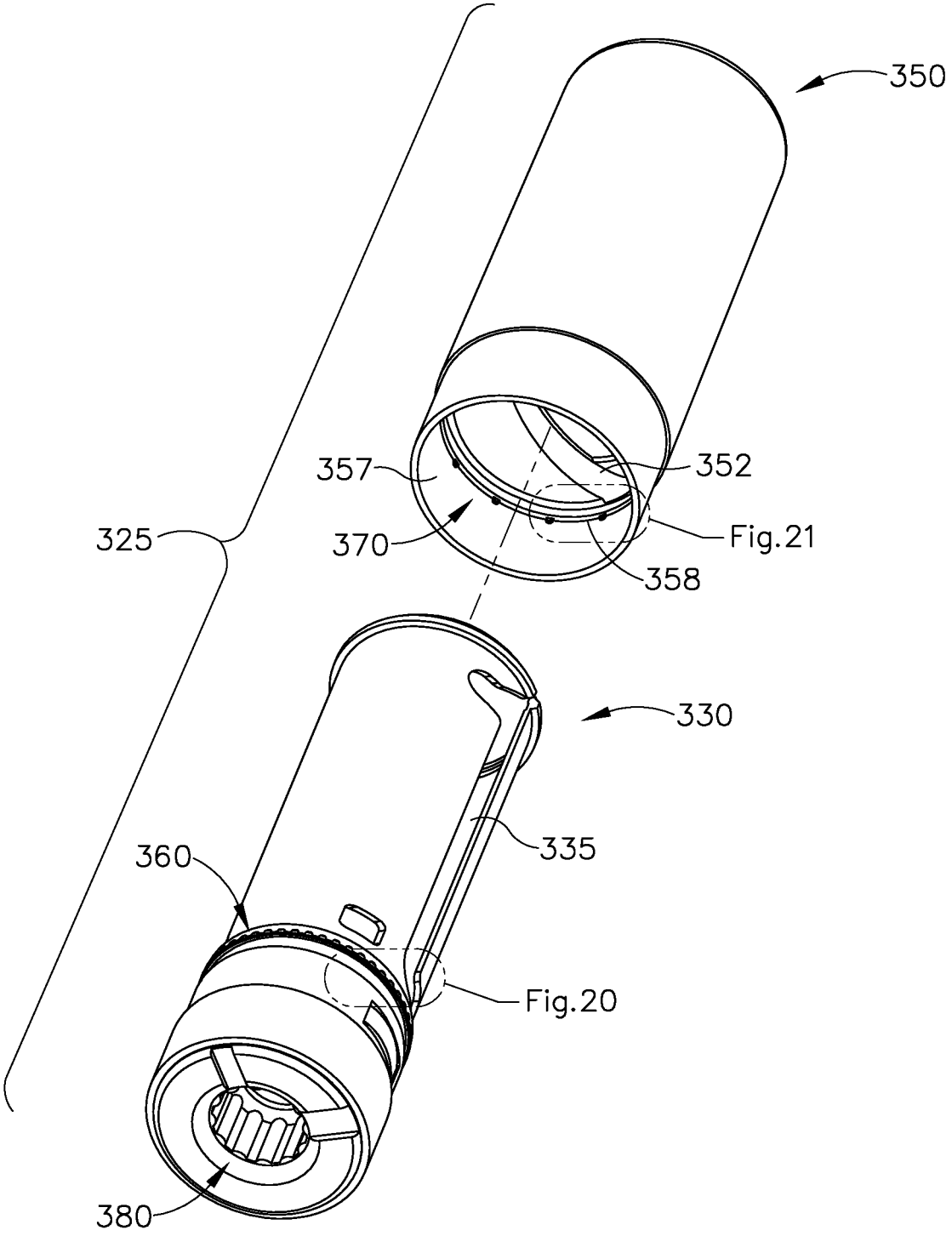
FIG. 19 shows a further alternative embodiment of a lockable refill dispensing tube of a refill lipstick cartridge having a mechanical locking means in separated components, including a spiral outer tube and a slotted inner tube.
Figure 20:
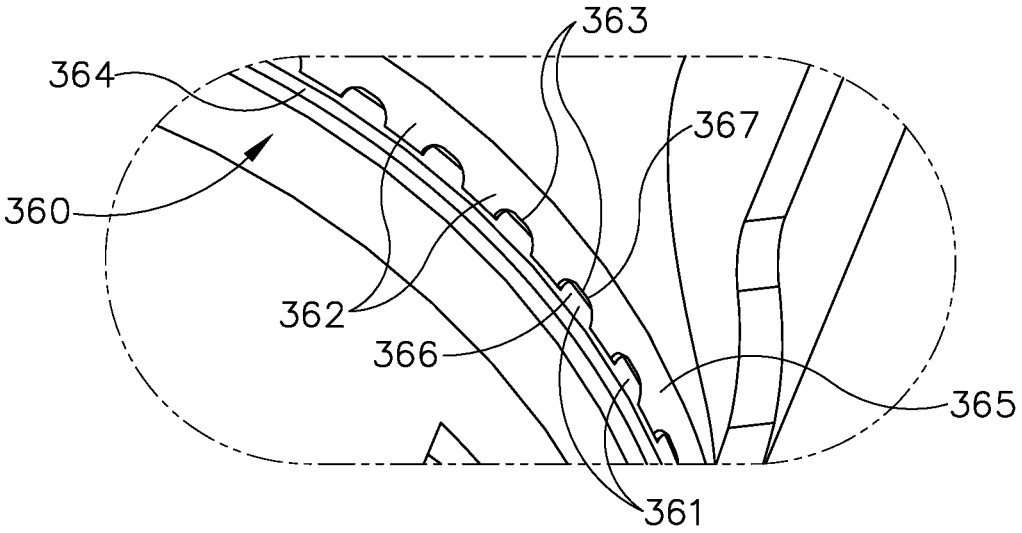
FIG. 20 shows an expanded view of the mechanical locking means, showing a series of mechanical locking elements of the slotted inner tube shown in FIG. 19.
Figure 21:
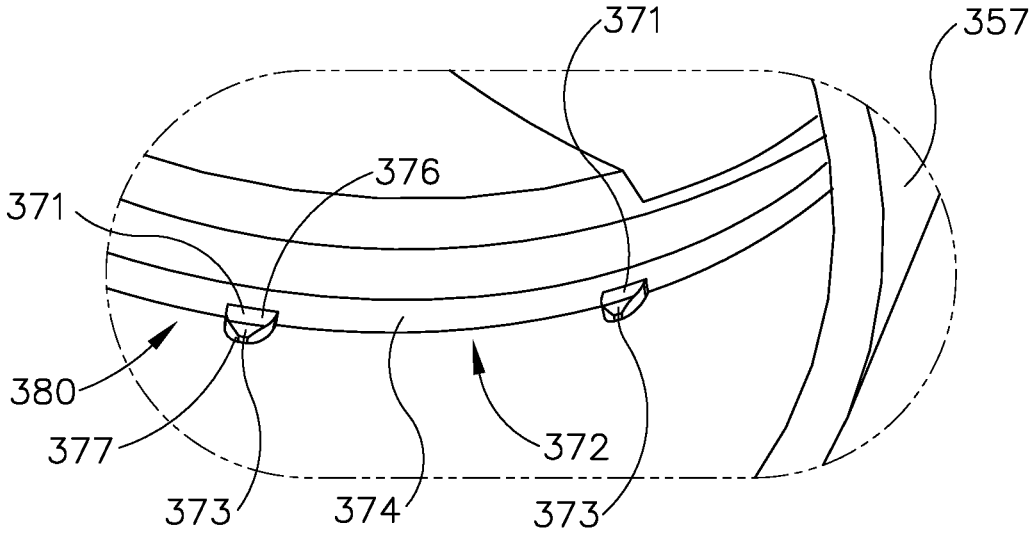
FIG. 21 shows an expanded view of the mechanical locking means, showing a series of mechanical locking elements of the spiral outer tube shown in FIG. 19.

A further alternative embodiment of a locking means for a refill lipstick cartridge is shown in FIGS. 19 through 26. This embodiment provides a locking means comprising a mechanical locking means. FIG. 19 shows a lockable refill dispensing tube 325 that can be used in a refill lipstick cartridge. The lockable refill dispensing tube 325 includes a slotted inner tube 330 and a spiral outer tube 350, disposed coaxially with and encircling the slotted inner tube 330. Like the lockable refill dispensing tube described hereinabove, the lockable refill dispensing tube 325 comprises a locking means, which comprises a mechanical locking means. The mechanical locking means includes one or more first locking elements 370 comprising a plurality of annularly-spaced-apart, inward projections 371, extending radially inwardly from the inside surface of a cylindrical wall, illustrated as annular lower wall 357, of the spiral outer tube 350. The mechanical locking means also includes one or more second locking elements 360 comprising a plurality of annularly-spaced-apart, outward projections 361, extending radially outwardly from the annular outer surface of the cylindrical wall, illustrated as outer lower wall 365, of the slotted inner tube 330.

The plurality of annularly-spaced-apart, outward projections 361 can include a series of teeth arranged along the outer lower wall 365 of the slotted inner tube 330, which are substantially equally spaced apart and aligned along the periphery. In the illustrated embodiment, forty-eight (48) outward projections, or teeth, 361 are used, each separated from the nearest adjacent teeth by a gap 362. The width (circumferential distance or arc length) of each gap 362 was approximately the width (circumferential length circumferential distance or) of the teeth 361. Preferably, each tooth 361, and each gap 362, is about 3 to 10 degrees in arc length, and typically the number of second locking elements 360 is about 15 to 60 teeth 361.

The plurality of annularly-spaced-apart, inward projections 371 can include a series of teeth arranged along the annular lower wall 357 of the spiral outer tube 350, which are substantially equally spaced apart and aligned along the periphery. In the illustrated embodiment, twelve (12) inward projections, or teeth, 371 are used, each separated from the nearest adjacent teeth by a wide space 372. In the illustrated embodiment, and in various embodiments, the width (circumferential distance or are length) of the inward projections/teeth 371 is substantially equal to the arc length of the outward projections/teeth 361, and correspondingly, substantially equal to the arc length of the gaps 362. Consequently, the arc length of the wide space 372 in the illustrated embodiment is approximately seven times the arc length of each inward projections/teeth 371. The width (circumferential distance or arc length) of each gap 362 was approximately the width (circumferential length circumferential distance or) of the teeth 361. Preferably, each tooth 371, is about 3 to 5 degrees in arc length, and separated by wide spaces 372 of about 15 to 30 degrees in arc length.

In various embodiments, the number of inward projections, or teeth, 371 of the spiral outer tube 350 are substantially fewer than the number of outward projections, or teeth, 361 of the slotted inner tube 330, while in other embodiments, the number of inward projections, or teeth, 371 of the spiral outer tube 350 are substantially greater than the number of outward projections, or teeth, 361 of the slotted inner tube 330. In other embodiments, the number of inward projections, or teeth, 371 of the spiral outer tube 350 are substantially equivalent to the number of outward projections, or teeth, 361 of the slotted inner tube 330.

In the locked configuration, the mechanical locking element(s), the plurality of inward projections or teeth 371 of the spiral outer tube 350 are disposed in axial alignment within the gaps 362 between two adjacent outward teeth 361 of the slotted inner tube 360, at which the spiral outer tube 350 is inhibited or prevented from relative rotation with the slotted inner tube 360. In the unlocked configuration of the locking means, the plurality of inward projections of the spiral outer tube are displaced axially from axial alignment with and are not disposed in a space between two adjacent outward projections of the slotted inner tube, to allow relative rotation.

Preferably, the arc length of the respecting teeth 371 and the greater number of the gaps 362, each gap 362 of arc length being substantially equal to the arc length of the teeth 371, allow the teeth 371 of the spiral outer tube 350 to quickly and easily align and engage the gaps 362 of the slotted inner tube 330, with minimal turning of the spiral outer tube 350, when the lockable refill dispensing tube 325 is manipulated from the unlocked configuration, back into the locked configuration. For example, in the illustrated embodiment, if the teeth 371 of the spiral outer tube 350 are angularly aligned with one of the teeth 361 of the slotted inner tube 330, preventing the user from bringing the respective outward teeth 361 and inward teeth 371 into axial alignment, the outer spiral outer tube 350 need only rotate at most 7.5 degrees to angularly align the teeth 371 with a gap 362 and move into locking engagement.

In various embodiments, each of the inward projections or teeth 371 of the spiral outer tube 350 has an inward face 376 (FIG. 21), typically a rectangular face surface having a vertical height and a lateral width (arc length). The inward projections or teeth 371 also include a lower portion 373 having a lower surface that tapers outwardly from the inward face 376 toward the inside surface of the annular lower wall 357. The lower portion 373 also has lateral sides that taper toward a distal bottom point 377.

Similarly, each of the outward projections or teeth 361 of the slotted inner tube 360 comprise has an outward face 366 (FIG. 20), typically a rectangular face surface having a vertical height and a lateral width (arc length). The outward projections or teeth 361 also include an upper portion 363 having an upper surface that tapers inwardly from the outward face 366 toward the outside surface of the outer wall 365. The upper portion 363 also has lateral sides that taper toward a distal top point 367.

The slotted inner tube 330 can include an annular lower rib 364 disposed on the outer wall 365, axially below the series of outward teeth 361. The annular lower rib 364 extends outwardly from the outer wall 365, radially and outwardly beyond the outer teeth 361. Also, the spiral outer tube 350 can include an annular upper rib 374 or series of ribs, disposed on the inward surface of the annular lower wall 357, axially above the series of inward teeth 371. The annular upper rib 374 extends inwardly from the outer wall 365, radially and inwardly beyond both the inner teeth 361 and the annular lower rib 364 of the slotted inner tube 330.

Figure 22:
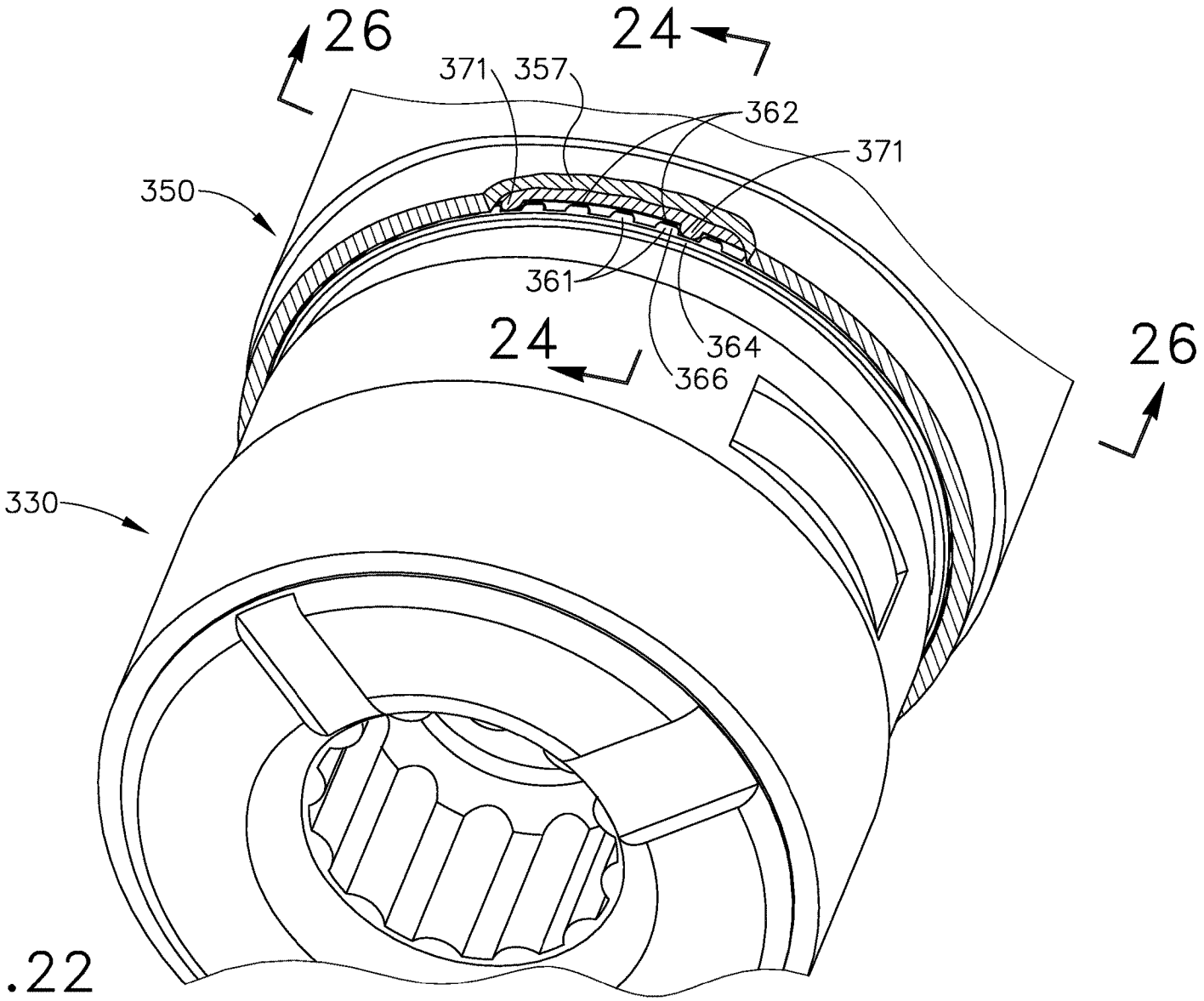
FIG. 22 shows the respective mechanical locking elements of the slotted inner tube and the spiral outer tube (shown in partial cut-away), disposed in a locked configuration.
Figure 23:
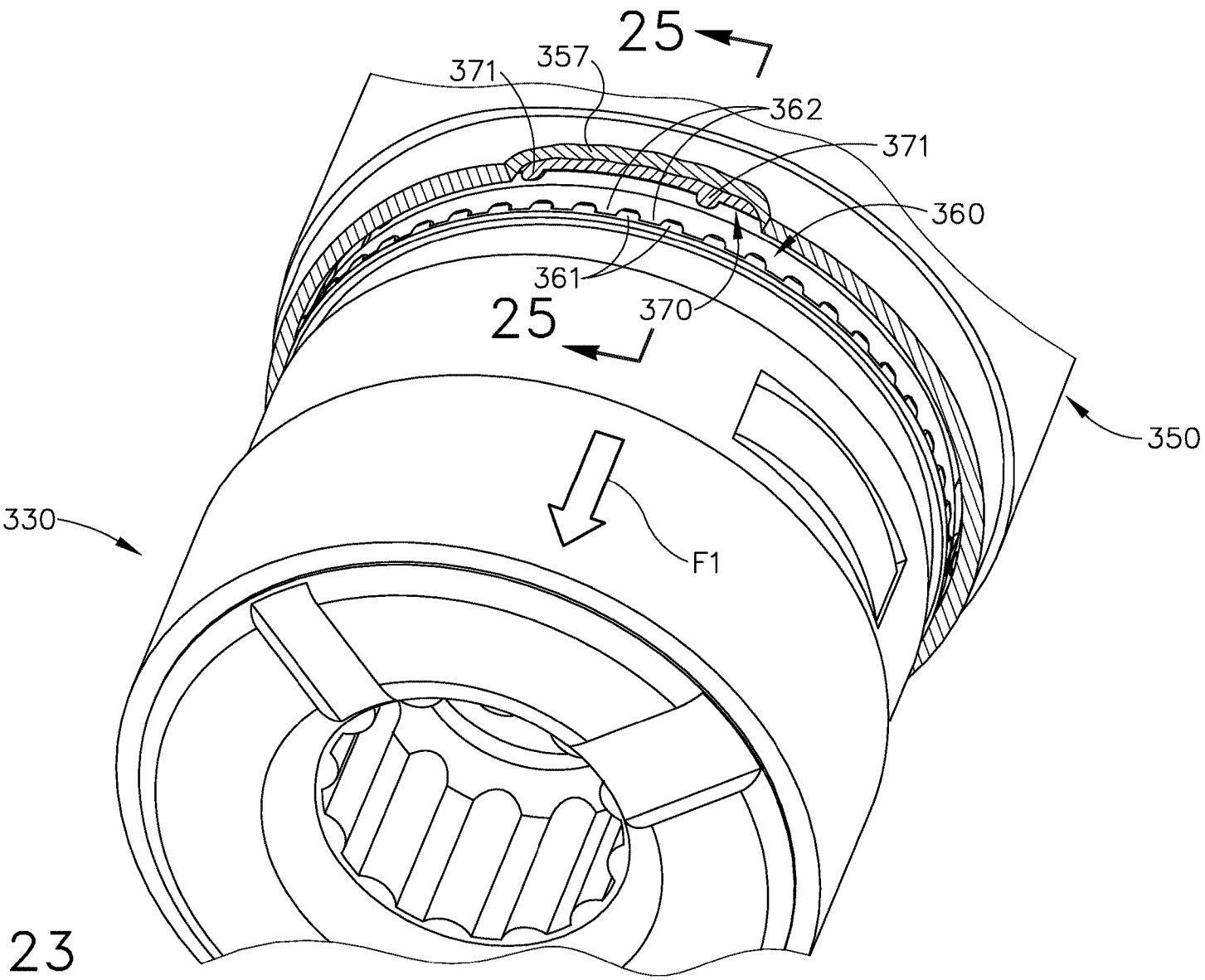
FIG. 23 shows the respective mechanical locking elements of the slotted inner tube and the spiral outer tube of FIG. 22, disposed in an unlocked configuration.
Figure 24:
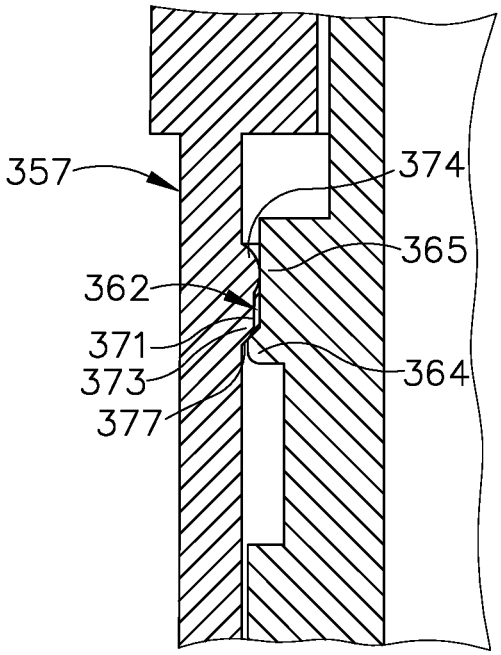
FIG. 24 shows an expanded sectional view of the respective mechanical locking elements of the slotted inner tube and the spiral outer tube, disposed in the locked configuration, taken through line 24-24 of FIG. 22.
Figure 26:
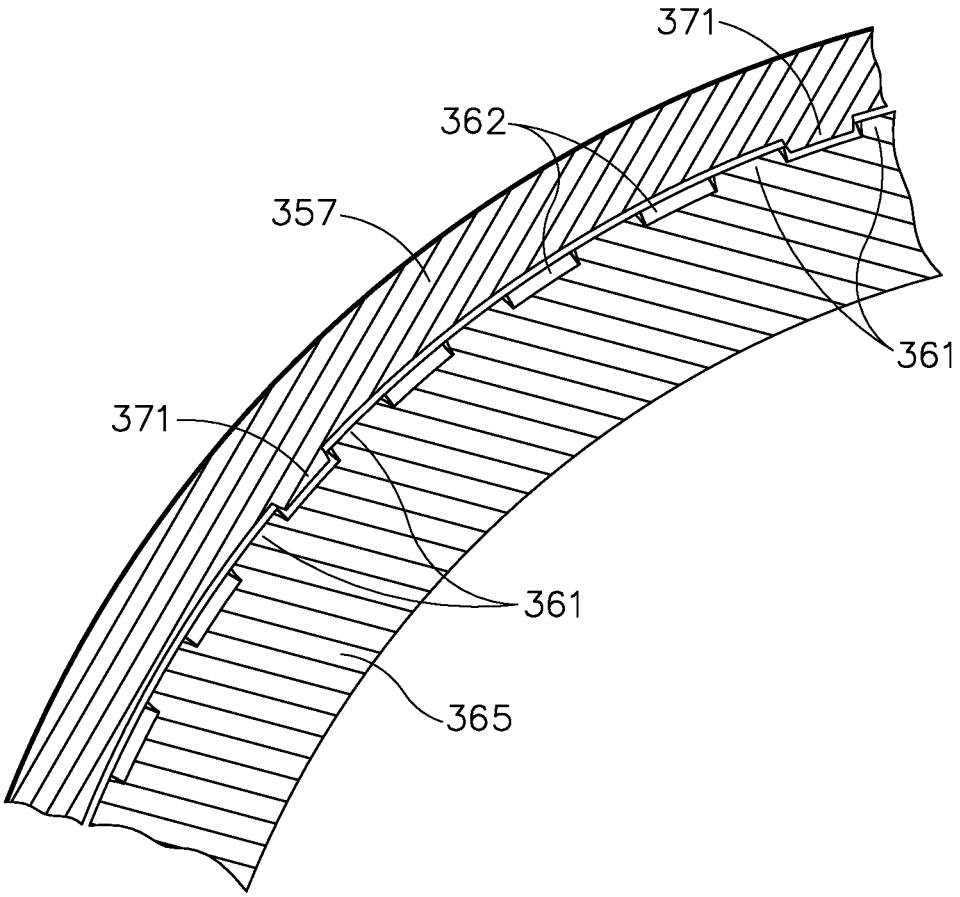
FIG. 26 shows a horizontal sectional view of the respective mechanical locking elements of the slotted inner tube and the spiral outer tube, disposed in the locked configuration, taken through line 26-26 of FIG. 22.

In the locked configuration, shown in FIGS. 22, 24 and 26, the inward faces 376 of the inward teeth 371 of the spiral outer tube 350 are engaged within the gaps 362 of, and aligned axially with the outward faces 366 of the outward teeth 361 of the slotted inner tube 330. In FIG. 22, as well as FIG. 23, the spiral outer tube 350 is shown in partial cut-away to reveal the structural detail of the slotted inner tube 330 therewithin.

The lower portions 373 of the inward teeth 371 axially confront with the annular lower rib 364 disposed on the slotted inner tube 330, axially below the series of outward teeth 361. Similarly, the upper portions 363 of the outward teeth 361 axially confront with the annular upper rib 374 disposed on the spiral outer tube 350, axially above the series of outward teeth 361.

The annular lower rib 364 of the slotted inner tube 330 provides an annular resistive protrusion that extends radially outwardly and overlaps a radially inwardly-extending lower rim that is provided by the annular upper rib 374 of the slotted inner tube 330. The annular resistive protrusion provides or increases a frictional force that is required for axial movement of the spiral outer tube 350 relative to the slotted inner tube 330, between the locked configuration and the unlocked configuration.

Figure 25:
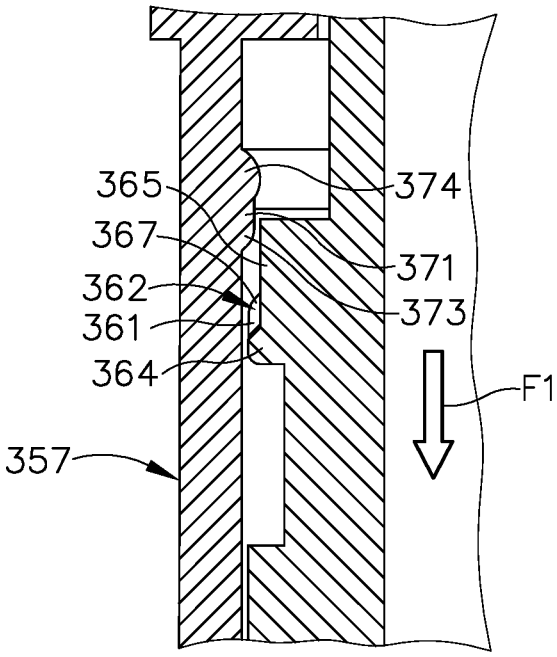
FIG. 25 shows an expanded sectional view of the respective mechanical locking elements of the slotted inner tube and the spiral outer tube, disposed in the unlocked configuration, taken through line 25-25 of FIG. 22.

An unlocking force is needed to manipulate the spiral outer tube 350 axially and downwardly along the slotted inner tube 330, from the locked configuration to the unlocked configuration. This is typically accomplished when the lockable refill dispensing tube 325 of a refill lipstick cartridge is inserted into the lower case 4 of a lipstick case. As shown in FIGS. 23 and 25, a downwardly-directed axial unlocking force, F1, is applied to the spiral outer tube 350 (or an outer cylindrical sleeve if present) while holding steady or restraining the slotted inner tube 330. The unlocking force passes both the inward teeth 371 and the annular upper rib 374 of the spiral outer tube 350 downwardly over and beyond the annular lower rib 364 of the slotted inner tube 330. The material of both the slotted inner tube 330 and the spiral outer tube 350 is sufficiently resilient to allow the sidewalls of both tubes to flex radially inwardly and outwardly, respectively, as shown in FIG. 25.

Insertion of the lockable refill dispensing tube 325 into the lower case 4 of the lipstick case can be accomplished similarly or identically to the insertion means of the frictional locking means embodiments described herein above.

Conversely, a locking force is needed to manipulate the spiral outer tube 350 axially and upwardly along the slotted inner tube 330, from the unlocked configuration to the locked configuration. This is typically accomplished when the refill lipstick cartridge is being removed from the lower case 4 of the lipstick case. Though not illustrated, it can be easily understood that an upwardly-directed axial locking force is applied to the spiral outer tube 350 (or an outer cylindrical sleeve if present) while the slotted inner tube 330 remains held in place within the lower case 4 of the lipstick case. The locking force upon the spiral outer tube 350 is sufficient to cause the sidewalls of both the slotted inner tube 330 and the spiral outer tube 350 to flex radially inwardly and outwardly, respectively, to pass first the annular upper rib 374, and then the inward teeth 371, of the spiral outer tube 350 upwardly over and beyond the annular lower rib 364 of the slotted inner tube 330, and into the locked configuration. Withdrawal of the lockable refill dispensing tube 325 from within the lower case 4 of the lipstick case can be accomplished similarly or identically to the extracting means of the frictional locking means embodiments described herein above.

Although the invention herein has been described with reference to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

I claim:

1. A refill lipstick cartridge that prevents or avoids operation of the dispensing mechanism for a lipstick bullet until the refill lipstick cartridge has been secured into a lower case of a lipstick case, the refill lipstick cartridge comprising:

(i) a spiral outer tube comprising a cylindrical wall, (ii) a slotted inner tube comprising a cylindrical wall, disposed concentrically within the spiral outer tube, wherein the slotted inner tube can be adapted to rotate within the spiral outer tube, and to move axially within the spiral outer tube between a locked position and an unlocked position, (iii) a lipstick cup disposed and adapted to move axially within the slotted inner tube when the slotted inner tube rotates within the slotted inner tube, and (iv) a locking means between the spiral outer tube and the slotted inner tube, wherein the locking means inhibits or prevents relative rotation between the spiral outer tube and the slotted inner tube when the spiral outer tube and the slotted inner tube are axially in the locked position, and the locking means does not inhibit relative rotation between the spiral outer tube and the slotted inner tube when the spiral outer tube and the slotted inner tube are axially in the unlocked position.

2. The refill lipstick cartridge of claim 1, wherein the spiral outer tube moves axially relative to the slotted inner tube, from the locked position to the unlocked position, when the refill lipstick cartridge is inserted into a lower case.

3. The refill lipstick cartridge of claim 2, wherein the locking means comprises a first locking element associated with an inside surface of the cylindrical wall of the spiral outer tube, and a second locking element associated with an annular outer surface of the cylindrical wall of the slotted inner tube, wherein the first locking element overlaps radially with the second locking element, and wherein the first locking element of the spiral outer tube overlaps axially with the second locking element of the slotted inner tube when the spiral outer tube and the slotted inner tube are axially in the locked position, and the first locking element of the spiral outer tube is displaced axially from, and does not overlap axially with, the second locking element of the slotted inner tube when the spiral outer tube and the slotted inner tube are axially in the unlocked position.

4. The refill lipstick cartridge of claim 3, wherein the locking means comprises a frictional locking means, the first locking element comprises one or more annular protrusions extending radially inwardly from the inside surface of the cylindrical wall of the spiral outer tube, and the second locking element comprises the annular outer surface of the cylindrical wall of the slotted inner tube, wherein in a locked configuration of the locking means, the inwardly-extending one or more annular protrusions of the spiral outer tube are engaged frictionally with the annular outer surface of the slotted inner tube, to inhibit or prevent relative rotation, and in an unlocked configuration of the locking means, the inwardly-extending one or more annular protrusions of the spiral outer tube are displaced axially from the annular outer surface of the slotted inner tube, and are respectively disengaged frictionally, to allow relative rotation.

5. The refill lipstick cartridge of claim 3, wherein the locking means comprises a mechanical locking means, the first locking element comprises a plurality of annularly-spaced-apart inward projections extending radially inwardly from the inside surface of the cylindrical wall of the spiral outer tube, and the second locking element comprises a plurality of annularly-spaced-apart outward projections extending radially outwardly from the annular outer surface of the cylindrical wall of the slotted inner tube, wherein in a locked configuration of the locking means, the plurality of inward projections of the spiral outer tube are disposed in axial alignment within a space between two adjacent outward projections of the slotted inner tube, to inhibit or prevent relative rotation, and in an unlocked configuration of the locking means, the plurality of inward projections of the spiral outer tube are displaced axially from axial alignment with and are not disposed in a space between two adjacent outward projections of the slotted inner tube, to allow relative rotation.

6. The refill lipstick cartridge of claim 5, wherein the inward projections comprise inward teeth, each inward tooth having an inward face and an lower surface that tapers outwardly from the inward face toward the inside surface of the cylindrical wall of the spiral outer tube, and the outward projections comprise outward teeth, each outward tooth having an outward face and an upper surface that tapers inwardly from the outward face toward the cylindrical wall of the slotted inner tube.

7. The refill lipstick cartridge of claim 1, wherein the locking means comprises a first locking element associated with an outside surface of the cylindrical wall of the slotted inner tube, and a second locking element associated with the cylindrical wall of the spiral outer tube, wherein the first locking element overlaps radially with the second locking element, and wherein the first locking element of the slotted inner tube overlaps axially with the second locking element of the spiral outer tube when the spiral outer tube and the slotted inner tube are axially in the locked position, and the first locking element of the slotted inner tube is displaced axially from, and does not overlap axially with, the second locking element of the spiral outer tube when the spiral outer tube and the slotted inner tube are axially in the unlocked position.

8. The refill lipstick cartridge of claim 7, wherein the locking means comprises a frictional locking means, the first locking element comprises one or more annular protrusions extending radially outwardly from the inside surface of the cylindrical wall of the slotted inner tube, and the second locking element comprises the annular inner surface of the cylindrical wall of the spiral outer tube, wherein in a locked configuration of the locking means, the outwardly-extending one or more annular protrusions of the inner slotted tube are engaged frictionally with the annular inner surface of the spiral outer tube, to inhibit or prevent relative rotation, and in an unlocked configuration of the locking means, the outwardly-extending one or more annular protrusions of the inner slotted tube are displaced axially from the annular inner surface of the spiral outer tube, and are respectively disengaged frictionally, to allow relative rotation.

9. The refill lipstick cartridge of claim 7, wherein the locking means comprises a mechanical locking means, the first locking element comprises a plurality of annularly-spaced-apart outward projections extending radially outwardly from the outside surface of the cylindrical wall of the slotted inner tube, and the second locking element comprises a plurality of annularly-spaced-apart inward projections extending radially inwardly from the annular inner surface of the cylindrical wall of the spiral outer tube, wherein in a locked configuration of the locking means, the plurality of inward projections of the spiral outer tube are disposed in axial alignment within a gap between two adjacent outward projections of the slotted inner tube, to inhibit or prevent relative rotation, and in an unlocked configuration of the locking means, the plurality of inward projections of the spiral outer tube are displaced axially from axial alignment with and are not disposed in a gap between two adjacent outward projections of the slotted inner tube, to allow relative rotation.

10. The refill lipstick cartridge of claim 9, wherein the outward projections of the slotted inner tube comprise outward teeth, each outward tooth having an outward face and an upper surface that tapers upwardly from the outward face toward the cylindrical wall of the slotted inner tube, and the inward projections of the spiral outer tube comprise inward teeth, each inward tooth having an inward face and an lower surface that tapers downwardly from the inward face toward the inside surface of the cylindrical wall of the spiral outer tube.

11. The refill lipstick cartridge of claim 4, wherein the spiral outer tube has an opposed pair of helical grooves formed into the inner surface of the cylindrical wall, the slotted inner tube has an opposed pair of vertical slots formed through the cylindrical wall, and the lipstick cup has a cylindrical wall, a lower base, and an opposed pair of pins that extend laterally from the outside surface of the cylindrical wall, the pins extending through the respective vertical slots in the slotted inner tube and a distal end of the pins disposed within the respective helical grooves of the spiral outer tube, wherein the lipstick cup can translate axially and vertically within the slotted inner tube when the spiral outer tube and the slotted inner tube are rotated relatively in opposite rotational directions.

12. The refill lipstick cartridge of claim 11, wherein the refill lipstick cartridge further comprises an outer cylinder that is fitted over and covers the entire outside surface of the spiral outer tube, and is secured to the spiral outer tube by a mechanical, friction-fit, or adhesive attachment, wherein the outer cylinder inhibits or prevents a user from rotating the spiral outer tube relative to the slotted inner tube, by manipulating only an outer cylindrical surface of the refill lipstick cartridge.

13. The refill lipstick cartridge of claim 4, wherein the slotted inner tube further includes a refill drive means fixed to the slotted inner tube, the refill drive means includes a rotation feature, the lower case of the lipstick case includes a rotation feature, and the lower case of the lipstick case slidably and adjustably receives the outer cylinder of the refill lipstick cartridge, wherein the rotation feature of the refill drive means cooperates with the rotation feature of the lower case of the lipstick case when the outer cylinder of the refill lipstick cartridge is received within the lower case of the lipstick case, whereby rotation of the lower case of the lipstick case correspondingly rotates the slotted inner tube, and wherein rotation of the lower case of the lipstick case while holding or preventing rotation of the outer cylinder results in axial and vertical translation of the lipstick cup within the slotted inner tube and within the refill lipstick cartridge.

14. The refill lipstick cartridge of claim 13, wherein the rotation feature of the refill drive means of the slotted inner tube is configured to be releasably secured to and engaged with the rotation feature of the lower case of the lipstick case, the rotation feature of the refill drive means includes a mechanical or frictional element, the rotation feature of the lower case includes a mechanical or frictional element, and wherein the rotation feature of the refill drive means mechanically or frictionally interferes with the corresponding or congruent frictional element on the rotation feature of the lower case, whereby an insertion force is required to releasably secure and engage the rotation feature of the refill drive means with the rotation feature of the lower case, to overcome the mechanical or frictional interference of the rotation feature between the frictional elements of the refill drive means and the frictional element of the rotation feature of the lower case.

15. The refill lipstick cartridge of claim 14, wherein the rotation feature of the refill drive means of the refill lipstick cartridge is configured to be withdrawn manually from engagement with the rotation feature of the lower case by an extraction force that overcomes the mechanical or frictional interference between the mechanical or frictional element of the rotation feature of the refill drive means and the mechanical or frictional element of the rotation feature of the lower case.

16. The refill lipstick cartridge of claim 15, wherein: the extraction force to withdraw the refill lipstick cartridge from the lower case is the same or substantially the same as the insertion force to insert the refill drive means into the lower case; an unlocking force to move the slotted inner tube axially within the spiral outer tube from the locked position to the unlocked position, is less than, and typically substantially less than, the insertion force to insert the refill drive means into the lower case; and a locking force to move the slotted inner tube axially within the spiral outer tube from the unlocked position to the locked position, is less than, and typically substantially less than, the extraction force to withdraw the refill lipstick cartridge from the lower case.

* * * * *